US010752412B1

(12) United States Patent
Hawry et al.

(10) Patent No.: US 10,752,412 B1
(45) Date of Patent: Aug. 25, 2020

(54) CHILD RESISTANT CONTAINER WITH PUMP ACTUATOR

(71) Applicant: Berlin Packaging, LLC, Chicago, IL (US)

(72) Inventors: Liam Hawry, Chicago, IL (US); Brett Niggel, Chicago, IL (US)

(73) Assignee: Berlin Packaging, LLC, Chicago, IL (US)

( * ) Notice: Subject to any disclaimer, the term of this patent is extended or adjusted under 35 U.S.C. 154(b) by 0 days.

(21) Appl. No.: 16/675,283

(22) Filed: Nov. 6, 2019

(51) Int. Cl.
*B65D 50/04* (2006.01)
*B05B 11/00* (2006.01)

(52) U.S. Cl.
CPC ..... *B65D 50/046* (2013.01); *B05B 11/3059* (2013.01)

(58) Field of Classification Search
CPC ..... B65D 50/046; B05B 11/3059
USPC ..... 222/153.13, 256, 321.3, 321.6, 321.7, 222/384, 519, 538, 571
See application file for complete search history.

(56) References Cited

U.S. PATENT DOCUMENTS

| | | | |
|---|---|---|---|
| 3,484,023 | A | 12/1969 | Meshberg |
| 4,162,746 | A | 7/1979 | Anderson |
| 4,572,410 | A | 2/1986 | Brunet |
| 4,836,423 | A | 6/1989 | Hayes |
| 4,848,595 | A | 7/1989 | Foster |
| 4,889,262 | A | 12/1989 | Toms |
| 4,991,746 | A | 2/1991 | Schultz |
| 5,115,980 | A | 5/1992 | Skorka |
| 5,314,093 | A | 5/1994 | Gross |
| 5,335,830 | A | 8/1994 | Cater |
| 5,388,730 | A | 2/1995 | Abbott |
| 5,445,299 | A | 8/1995 | Harriman |
| 5,772,080 | A | 6/1998 | De |
| 5,878,916 | A | 3/1999 | Dejonge |
| 5,899,363 | A | 5/1999 | Bliss |
| 6,196,423 | B1 | 3/2001 | Erxleben |
| 6,604,656 | B1 | 8/2003 | Tseng |
| 6,691,896 | B2 | 2/2004 | Meshberg |
| 6,932,244 | B2 | 8/2005 | Meshberg |
| 7,014,068 | B1 | 3/2006 | Cohen |
| 7,168,594 | B2 | 1/2007 | Law |
| D561,024 | S | 2/2008 | Altonen |
| 7,510,101 | B2 | 3/2009 | Foster |
| D608,655 | S | 1/2010 | Brewer |

(Continued)

FOREIGN PATENT DOCUMENTS

| | | |
|---|---|---|
| CN | 107051774 | 8/2017 |
| CN | 208746628 | 4/2019 |

(Continued)

OTHER PUBLICATIONS

Plastic twist up airless pump bottle 15ml 30ml 50ml, Global Sources, globalsources.com, May 10, 2019.

(Continued)

*Primary Examiner* — Vishal Pancholi
(74) *Attorney, Agent, or Firm* — Adam K. Sacharoff; Much Shelist, P.C.

(57) ABSTRACT

In one embodiment there is provided a child-resistant container assembly. The assembly includes a bottle with a dispensing mechanism and a collar. The dispensing mechanism draws and ejects a liquid out of the bottle when the actuator is pressed down. To unlock the container, the collar is pressed downwardly and then turned to unlock the dispensing mechanism.

11 Claims, 24 Drawing Sheets

(56) References Cited

U.S. PATENT DOCUMENTS

| | | | |
|---|---|---|---|
| D613,614 | S | 4/2010 | Rodriguez |
| 7,735,688 | B2 | 6/2010 | Foster |
| 7,775,402 | B2 | 8/2010 | Yoshida |
| 7,874,461 | B2 | 1/2011 | Bae |
| 8,292,124 | B2 | 10/2012 | Guenther |
| 8,292,532 | B2 | 10/2012 | Nasu |
| 8,308,029 | B2 | 11/2012 | Ki |
| 8,439,230 | B2 | 5/2013 | Hagen |
| 8,490,837 | B2 | 7/2013 | Michaux |
| D696,962 | S | 1/2014 | Chen |
| D699,047 | S | 2/2014 | Lissoni |
| 8,662,775 | B1 | 3/2014 | Liu |
| 8,695,852 | B2 | 4/2014 | Bertin |
| 8,777,061 | B1 | 7/2014 | Meshberg |
| 8,863,988 | B2 | 10/2014 | Kang |
| 8,978,933 | B2 | 3/2015 | Muller |
| 9,010,581 | B2 | 4/2015 | Presche |
| 9,180,475 | B2 | 11/2015 | Cho |
| 9,186,689 | B2 | 11/2015 | Kim |
| 9,277,797 | B2 | 3/2016 | Chen |
| D758,879 | S | 6/2016 | Chen |
| 9,598,225 | B2 | 3/2017 | Patil |
| 9,745,117 | B2 | 8/2017 | Kim |
| 9,789,502 | B2 | 10/2017 | Maddy |
| 9,839,929 | B2 | 12/2017 | Deman |
| 9,894,980 | B2 | 2/2018 | Kim |
| 9,937,509 | B2 | 4/2018 | Dejong |
| 9,937,511 | B2 | 4/2018 | Goettke |
| 10,010,897 | B2 | 7/2018 | Espinoza |
| 10,138,971 | B1 | 11/2018 | Deman |
| 10,220,401 | B2 | 3/2019 | Puviland |
| 10,232,393 | B2 | 3/2019 | Dumont |
| 2003/0010793 | A1 | 1/2003 | Ritsche |
| 2015/0090741 | A1 | 4/2015 | Laffey |
| 2018/0361413 | A1 | 12/2018 | Ruan |
| 2019/0054486 | A1 | 2/2019 | Deman |
| 2019/0118205 | A1 | 4/2019 | Knight |

FOREIGN PATENT DOCUMENTS

| | | |
|---|---|---|
| EP | 1674162 | 4/2008 |
| EP | 2859957 | 4/2015 |
| EP | 2893833 | 9/2016 |
| FR | 2983046 | 3/2014 |
| JP | 6394288 | 1/2014 |
| KR | 200440940 | 7/2008 |
| KR | 200459801 | 4/2012 |
| KR | 200470941 | 1/2014 |
| WO | 2008072833 | 6/2008 |
| WO | 2008150810 | 12/2008 |
| WO | 2009030428 | 3/2009 |
| WO | 071390 S | 9/2009 |
| WO | 2011071301 | 11/2011 |
| WO | 2012074162 | 6/2012 |
| WO | 2012074163 | 6/2012 |
| WO | 2013035976 | 3/2013 |
| WO | 2013068188 | 5/2013 |
| WO | 2014111252 | 7/2014 |
| WO | 2014111253 | 7/2014 |
| WO | 2014128007 | 8/2014 |
| WO | 2015143828 | 10/2015 |
| WO | 2017073920 | 5/2017 |
| WO | 2017211585 | 12/2017 |
| WO | 2018048998 | 3/2018 |
| WO | 2018126397 | 7/2018 |
| WO | 2018215659 | 11/2018 |

OTHER PUBLICATIONS

Airless Bottle, Shiny Silver Twist Up Dispenser, Platinum Body, 50 mL, CPR: Cosmetic Packaging Resources, cprsale.com, May 10, 2019.

Airless Pump Bottle Refillable Container Set—3 Pack (1 each—0.5 oz, 1 oz, and 1.7 oz), Juvitus, juvitus.com, May 10, 2019.

Airless Frosted Silver Pump Bottle Refillable Travel Container—0.5 fl oz + Travel Bag and Funnel, Juvitus, juvitus.com, May 10, 2019.

Black Soap Dispenser Pump and Stopper, FDC, factorydirectcraft.com, Item# 331028, May 10, 2019.

15ML 30ML 50ML Acrylic Vacuum Pressure Bottle Cosmetic Airless Bottle Essence Small Sub Bottle of Cosmetics Packaging, AliExpress, aliexpress.com, May 10, 2019.

Flowery Twist Lock Beauty Pump White, Allergo Meidcal, allegromedical.com, May 10, 2019.

Airless Twist Up Pump Serum Acrylic Bottles—15 ml / 0.5 oz. (White), Beauty Makeup Supply, beauty-makeup-supply.com, May 10, 2019.

CHILD RESISTANT CONTAINER WITH PUMP ACTUATOR

FIELD OF THE INVENTION

The present invention relates generally to a packaged assembly of a container with a pump actuator, which has a child resistant senior friendly functionality.

BACKGROUND OF THE INVENTION

Container assemblies typically include a closure that may contain a pharmaceutical or nutritional product within a bottle or other container. The cap may be "child-resistant," such that the cap is difficult for children to turn. In yet other assemblies, it may be necessary to include a pump actuator to retrieve the contents. It would be desirable to construct and implement an extremely simple push down and turn child resistant closure which is easy for adults to open while maintaining child resistance, and that in the open position allow the pump actuator to be depressed for pumping contents out of the container.

SUMMARY OF THE INVENTION

In one embodiment of the present invention there is provided a child-resistant, adult-friendly, container assembly to dispense a liquid. The container assembly includes a bottle having an internal reservoir for containing a liquid. A dispensing mechanism is secured to the bottle and used to manually dispense the liquid. The dispensing mechanism has a head piece configured to be actuated directly by a user. The dispenser mechanism is in communication with the internal reservoir and has an outlet configured for dispensing the liquid external to the container assembly when the head piece is actuated downwardly from a resting position.

The container assembly further includes a collar surrounding the dispensing mechanism and configured for movement in relation to the dispensing mechanism. The collar has locked, unlocked, and intermediate orientations. The locked orientation is configured to prevent actuation of the dispensing mechanism and to prevent twisting of the collar in a first direction. The unlocked orientation permits actuation of the dispensing mechanism and to permit twisting of the collar in a second direction. The intermediate orientation is configured to allow twisting of the collar in the first direction to the unlocked orientation. The collar further has a ledge and an adjacent slot, wherein the outlet in the headpiece is positioned on the ledge when the collar is in the locked orientation and positioned in the slot when the collar is in the unlocked orientation.

The container assembly further includes a housing sleeve. The housing sleeves has a first portion secured to the bottle and has at least one locking lug to prevent separation of the bottle from the housing sleeve. The housing sleeve further has a second portion secured to the dispensing mechanism to prevent separation and prevent rotational movement of the dispensing mechanism in relation to the bottle.

The container assembly further includes a shoulder spring sleeve fitted around the second portion of the housing sleeve and configured to rotate in relation to the housing sleeve. The shoulder spring sleeve is secured to the collar such that movement of the collar causes movement of the shoulder spring sleeve.

In an aspect of the container assembly the dispensing mechanism further includes a compression spring configured to force the head piece back to the resting position when pressed downwardly to eject liquid from the bottle.

In yet another aspect of the container assembly the first portion of the housing sleeve is further defined as having a housing base defined between the first portion and second portion. The first portion being further defined to include a centered annular well extending dowrnwardly from the base. The annular well has threads configured to cooperate with threads defined on a neck of the bottle for securing the two together. The annular well is also bored through the housing base to permit a portion of the dispensing mechanism into the internal reservoir of the bottle. The first portion further includes an outer skirt extending downwardly from an edge of the housing base with strengthening members positioned between the outer skirt and the well to prevent flexing of the outer skirt. The second portion being further defined to include housing panels extending upwardly from the housing base and curving around the bored annular well in the housing base. The housing panels being spaced from each other to define housing gaps therebetween.

In another aspect of the container assembly the annular well of the housing sleeve has a bottom edge with at least one ramp extending therefrom. The at least one ramp is configured to lock against the at least one locking lug when the annular well is fully threaded to the bottle neck thereby preventing counter-rotation and removal of the bottle.

In yet another aspect of the container assembly, the collar and the housing sleeve are configured to work in concert to provide the unlocked, locked, and intermediate orientations. The housing sleeve is further defined to include at least one channel on the outer skirt of the first portion of the housing sleeve. Each channel having an entrance ramp, first and second rotational stop flanges positioned downwardly on the channel and positioned on either side of the entrance ramp, and a guidepost positioned on one side of the channel opposite to the first rotational stop flange and between the entrance ramp and the second rotational stop flange. The guidepost further has a detent adjacent to and positioned below the ramp and has a sloped projection between the detent and the second rotational stop flange. In this aspect, the collar further includes at least one internally extending projection. Each projection corresponding to at least one channel. When the collar is assembled over the housing sleeve, the internally extending projection secures over the entrance ramp, thus, preventing removal of the collar from the housing sleeve. In combination, the collar and housing sleeve define (a) the locked orientation that prevents twisting movement of the collar, when the projection is secured below the entrance ramp and positioned between the first rotational stop flange and the detent, (b) the intermediate orientation that allows twisting movement of the collar, when the collar is pushed down such that the projection is below the detent, and (c) the unlocked orientation, when the collar is positioned between the detent and the second rotational stop flange.

In other aspects of the container assembly, the collar and the shoulder spring sleeve are configured to work in concert to maintain the collar in an upward position. The shoulder spring sleeve has a shoulder portion extending from a circular opening. The shoulder portion having slots defined around the periphery thereof. The circular opening being sized to receive the housing panels on the housing sleeve. Shoulder panels extend upwardly around the circular opening and positioned such that the housing panels are adjacent to the inside of the shoulder panels. The shoulder panels are also spaced from each other to create shoulder gaps therebetween. Each shoulder gap has a knob extending inwardly and being configured to extend in the housing gaps between the housing panels. The shoulder portion is further made of a material configured to resist bending. The collar includes a plurality of elongated ribs extending downwardly along an internal surface of the collar. The plurality of elongated ribs is defined as a first set of short ribs interspaced between a second set of long ribs. Each of the long ribs are equally spaced from each other and defined to have a lower end fitted into one of the slots on shoulder spring sleeve, thereby securing the collar to the shoulder spring sleeve. Each of the short ribs being defined to having a lower end positioned against an edge of the shoulder portion, wherein when assembled, rotation of the collar causes rotation of the shoulder spring sleeve and a downward force externally exerted onto the collar, causes the short ribs to flex the shoulder portion which will return the collar to an upward resting position when the downward force is released.

In yet another aspect of the container assembly, the head piece includes the outlet and a conduit in fluid connection between the outlet and the internal reservoir of the bottle. The head piece further has an exterior annular skirt extending downwardly and an interior annular skirt extending downwardly within the exterior annular skirt, and pairs of ribbing members connecting the exterior skirt to the interior skirt.

The container assembly may also be defined to have the collar, head piece, housing sleeve, and the shoulder spring sleeve configured to work in concert when assemble. The pairs of ribbing members are configured to extend from the head piece into the housing gaps between the housing panels to prevent rotation of the head piece when the collar is rotated. The configuration also defines both an unaligned and aligned position. The unaligned position is defined when the collar is in the locked orientation such that the housing gaps and shoulder gaps overlap such that the shoulder panels are positioned below the pairs of ribbing members to prevent the head piece from being pressed downwardly. The aligned position is defined when the collar and shoulder spring are rotated to the unlocked orientation which is caused when the housing gaps and shoulder gaps align to create a channel between the housing panels and shoulder panels obstructing the ribbing members and allowing for horizontal movement of the head piece.

In another aspect of the container assembly, one of the shoulder panels has a top portion with a notch and one of the housing panels has a top portion with a notch. When the collar rotates to the unlocked orientation, the shoulder panel notch and the housing panel notch align to accommodate the conduit on the underside of the head piece when the head piece is pressed downwardly.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION THE DRAWINGS

Figure 1:
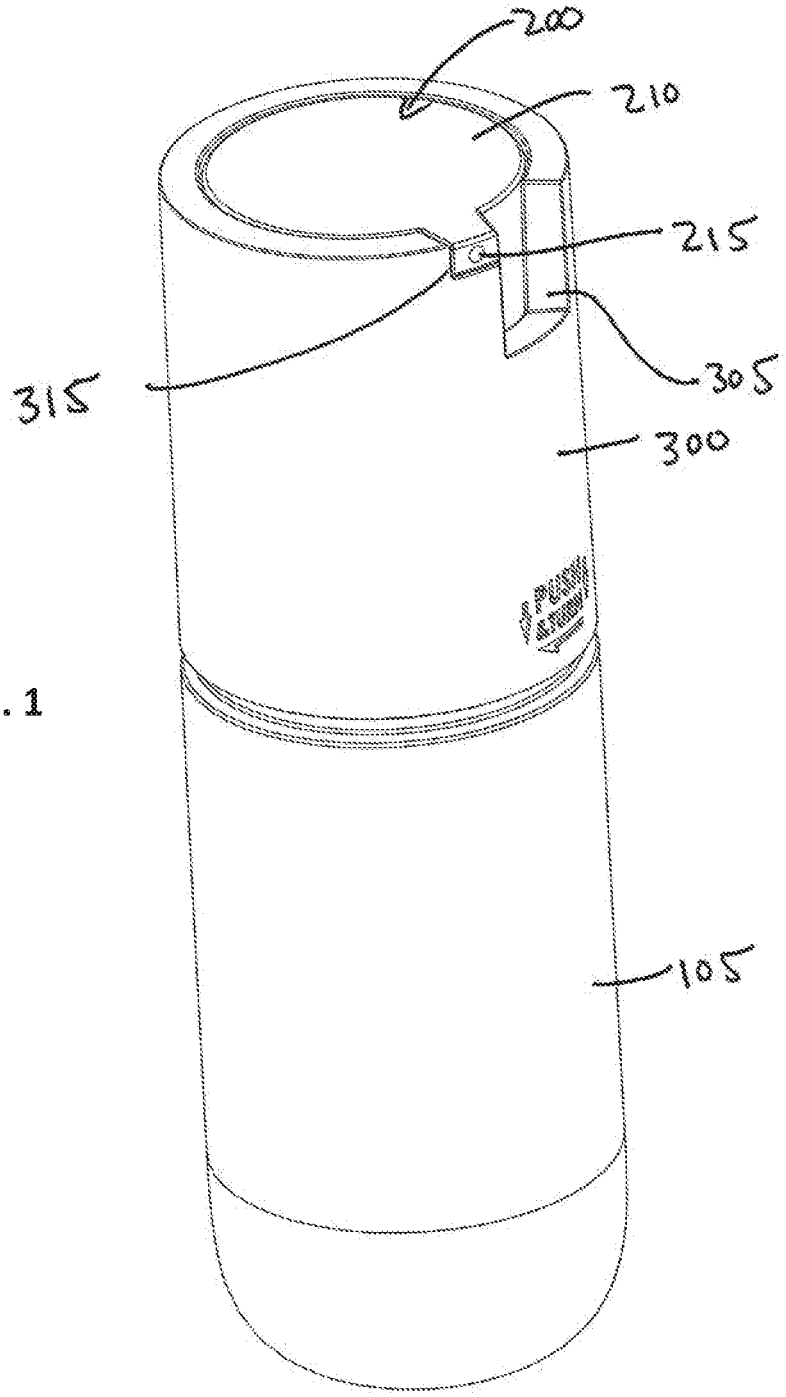
FIG. 1 is a perspective view of a child resistant, senior friendly container assembly illustrated in the locked position.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
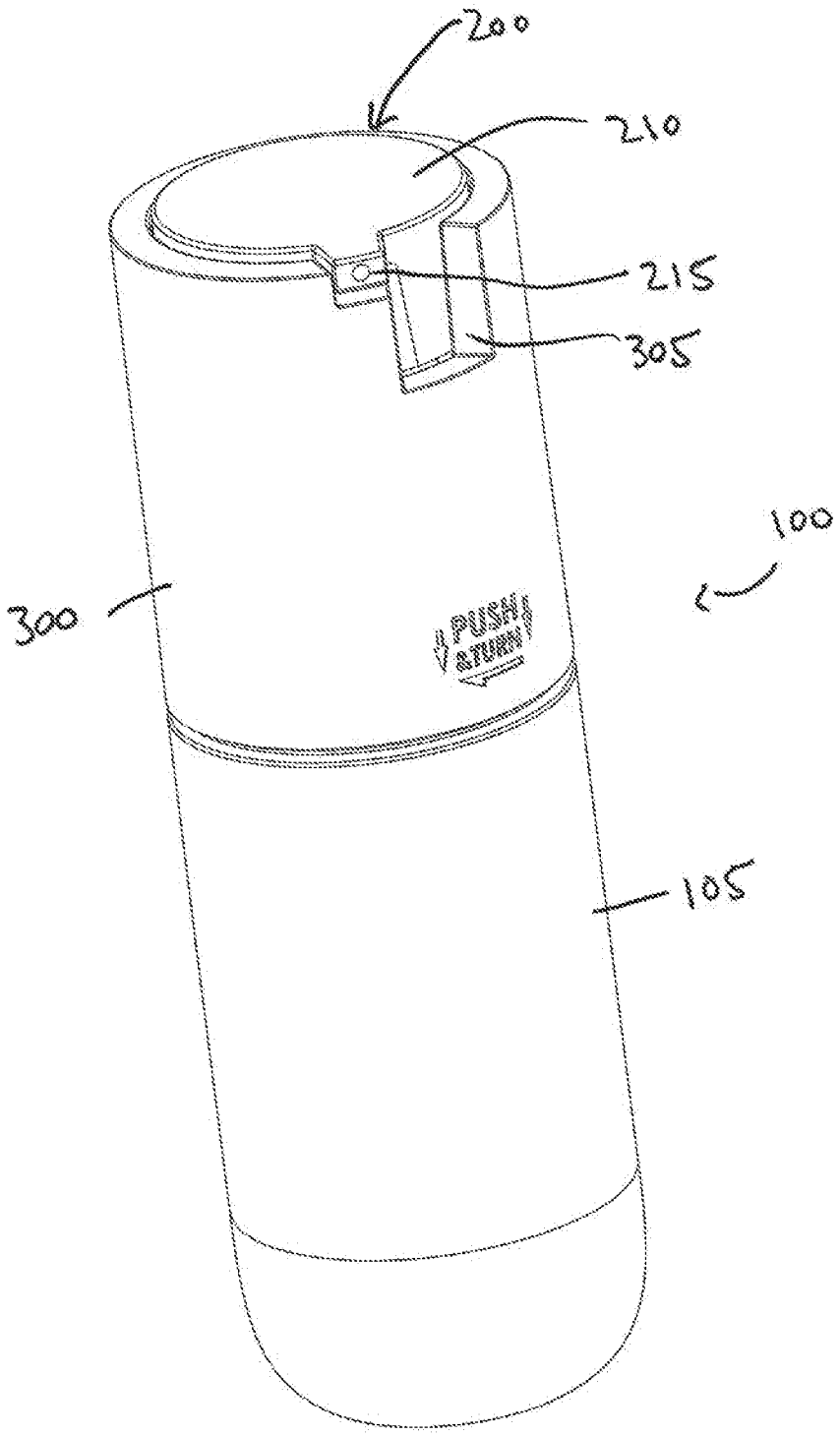
FIG. 2 is a perspective view of the container assembly illustrated with a collar in a pressed down position.
Figure 3:
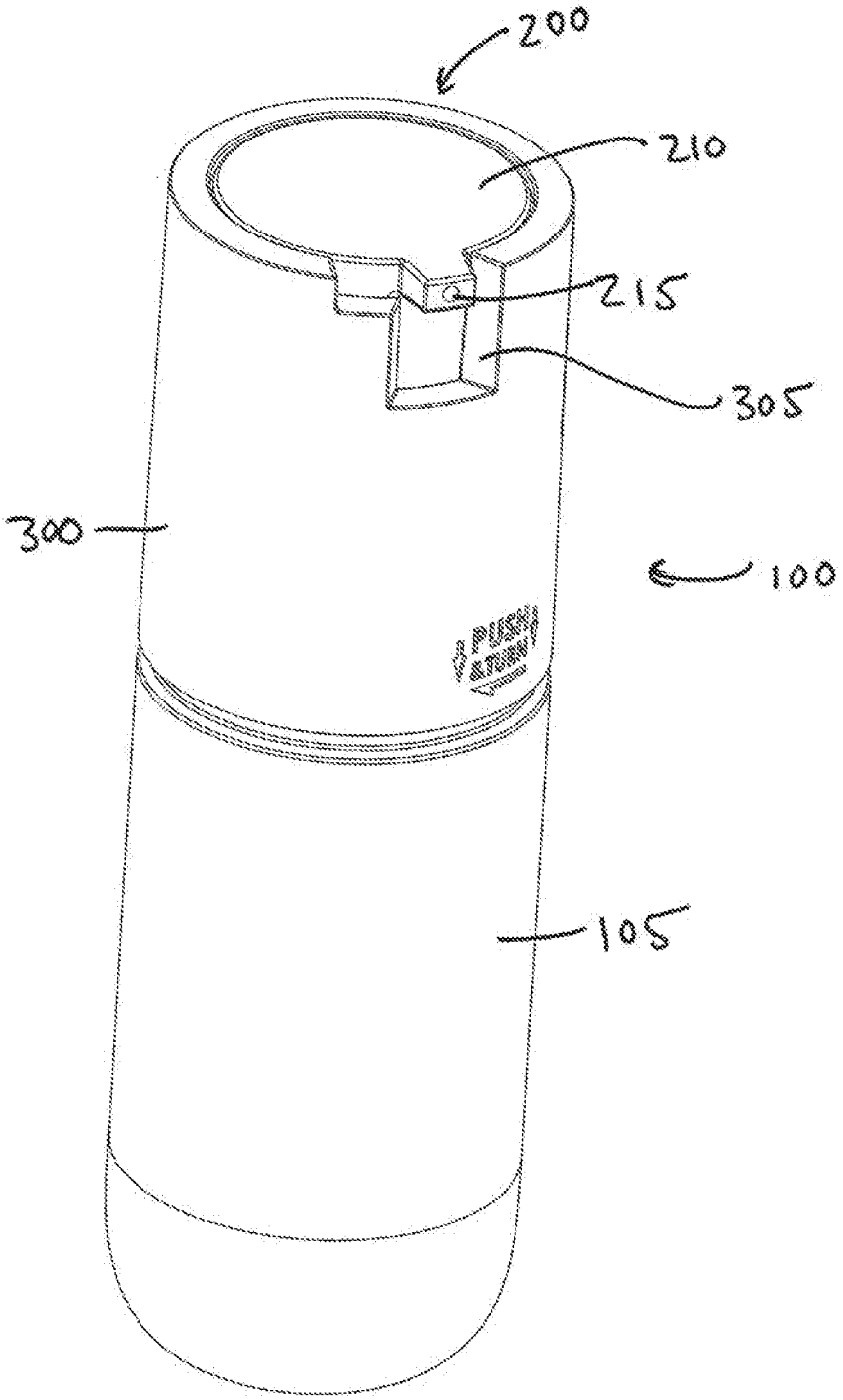
FIG. 3 is a perspective view of the container assembly illustrated in the unlocked position.
Figure 4:
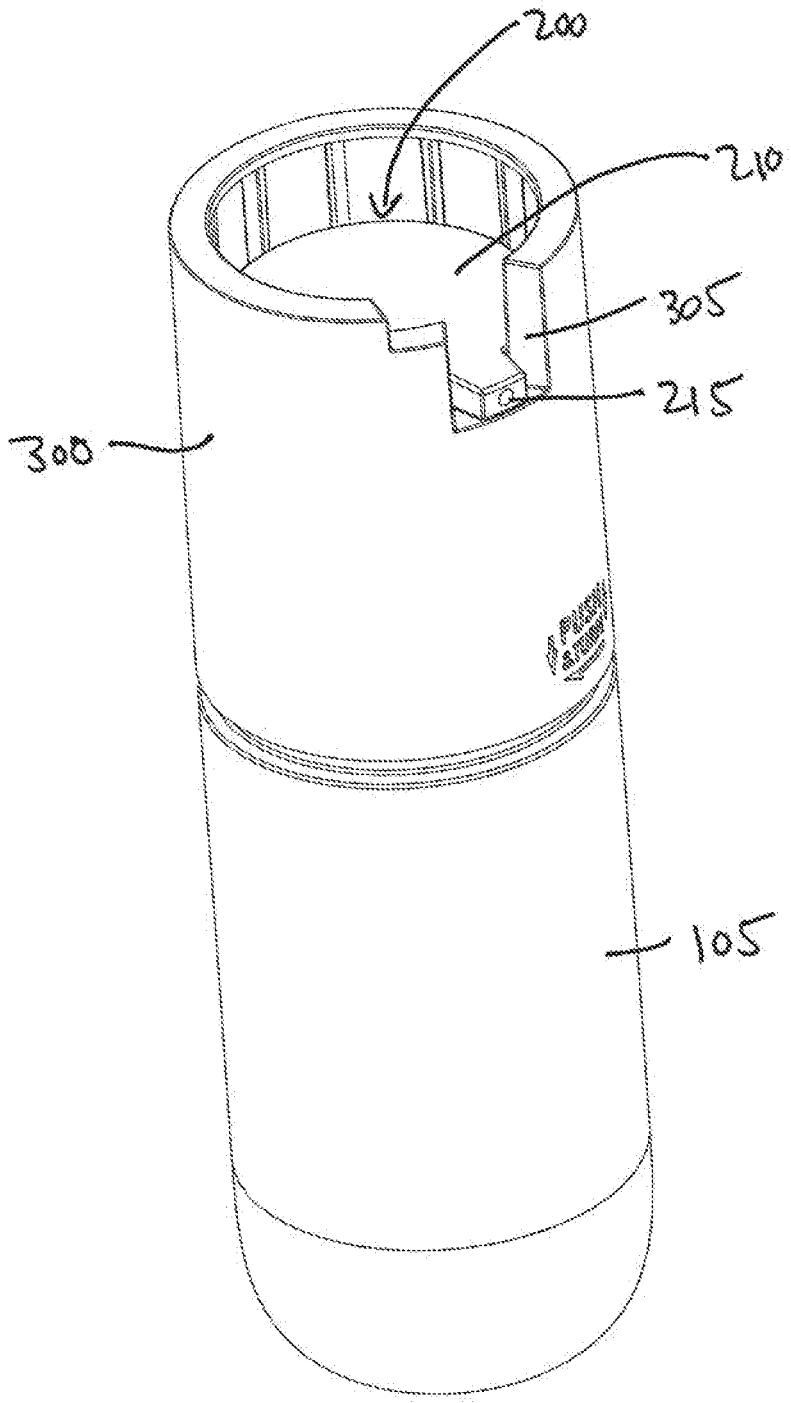
FIG. 4 is a perspective view of the container assembly illustrated with its actuator in a pressed down position.
Figure 5:
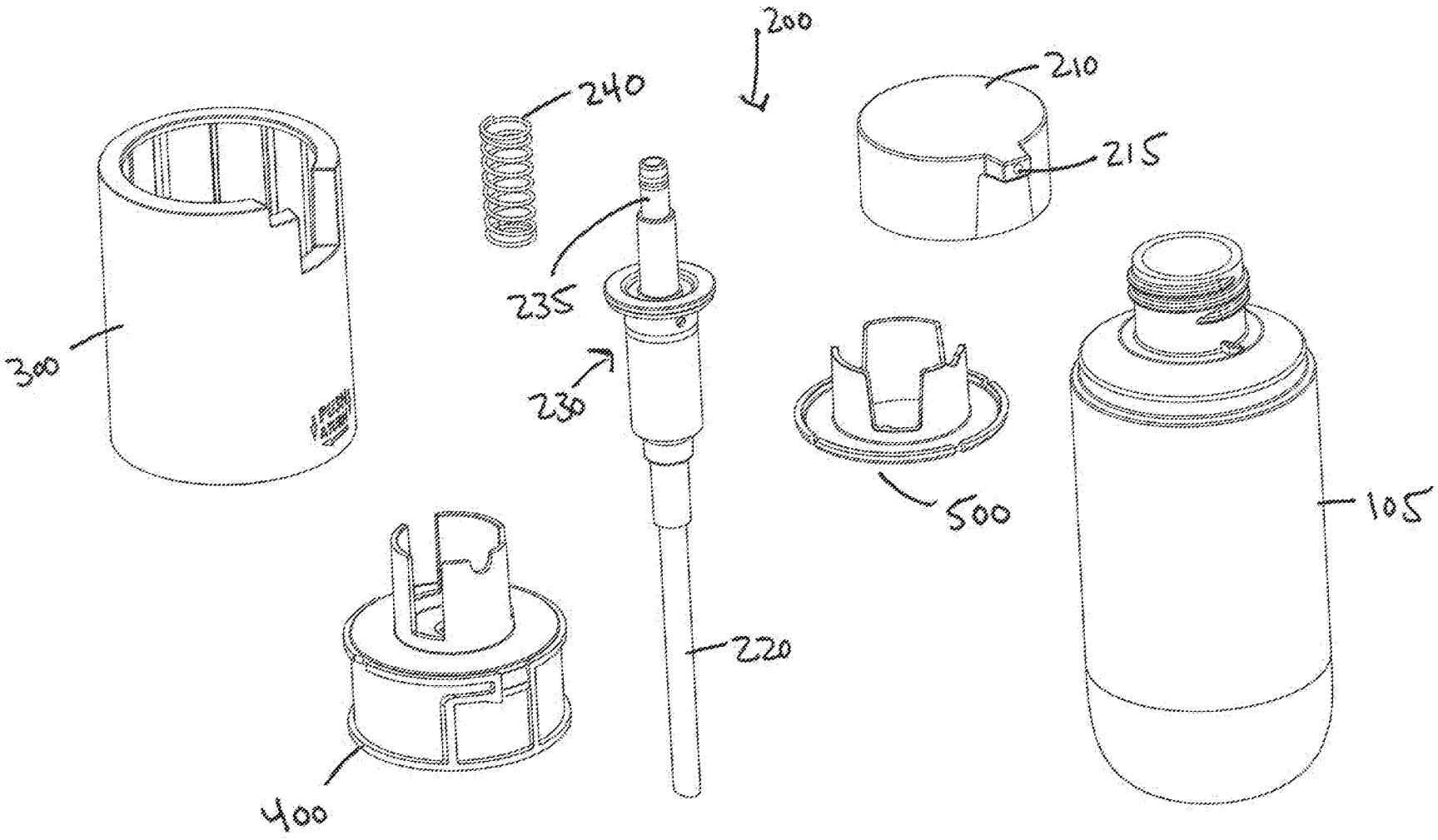
FIG. 5 is an exploded view of components of a child resistant, senior friendly container assembly in accordance with an embodiment of the invention.
Figure 6:
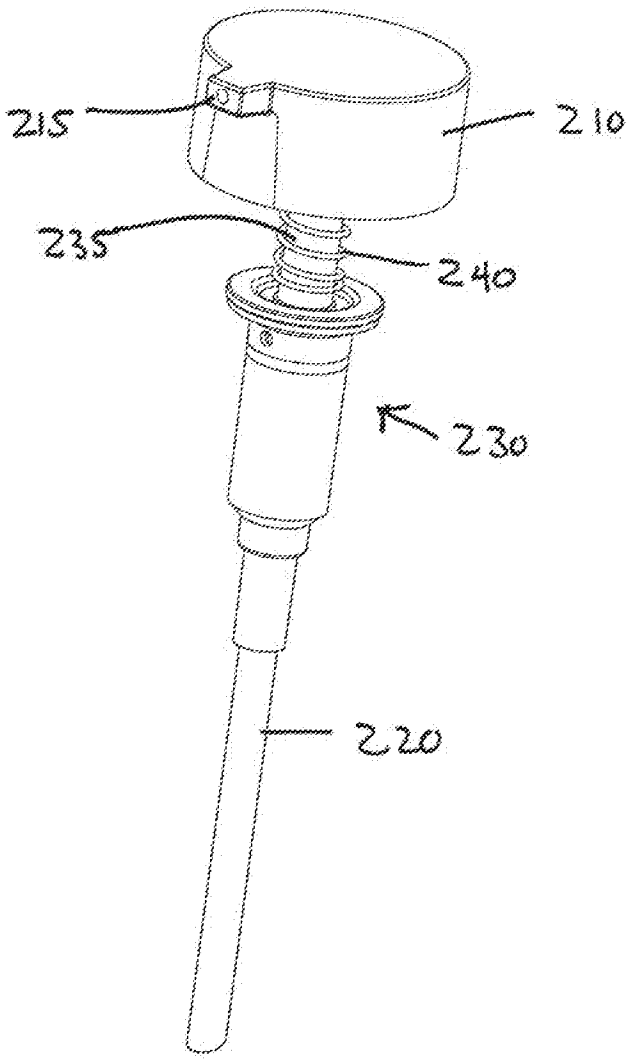
FIG. 6 is a perspective view of a dispensing mechanism for use with a child resistant, senior friendly container assembly in accordance with an embodiment of the invention.
Figure 7:
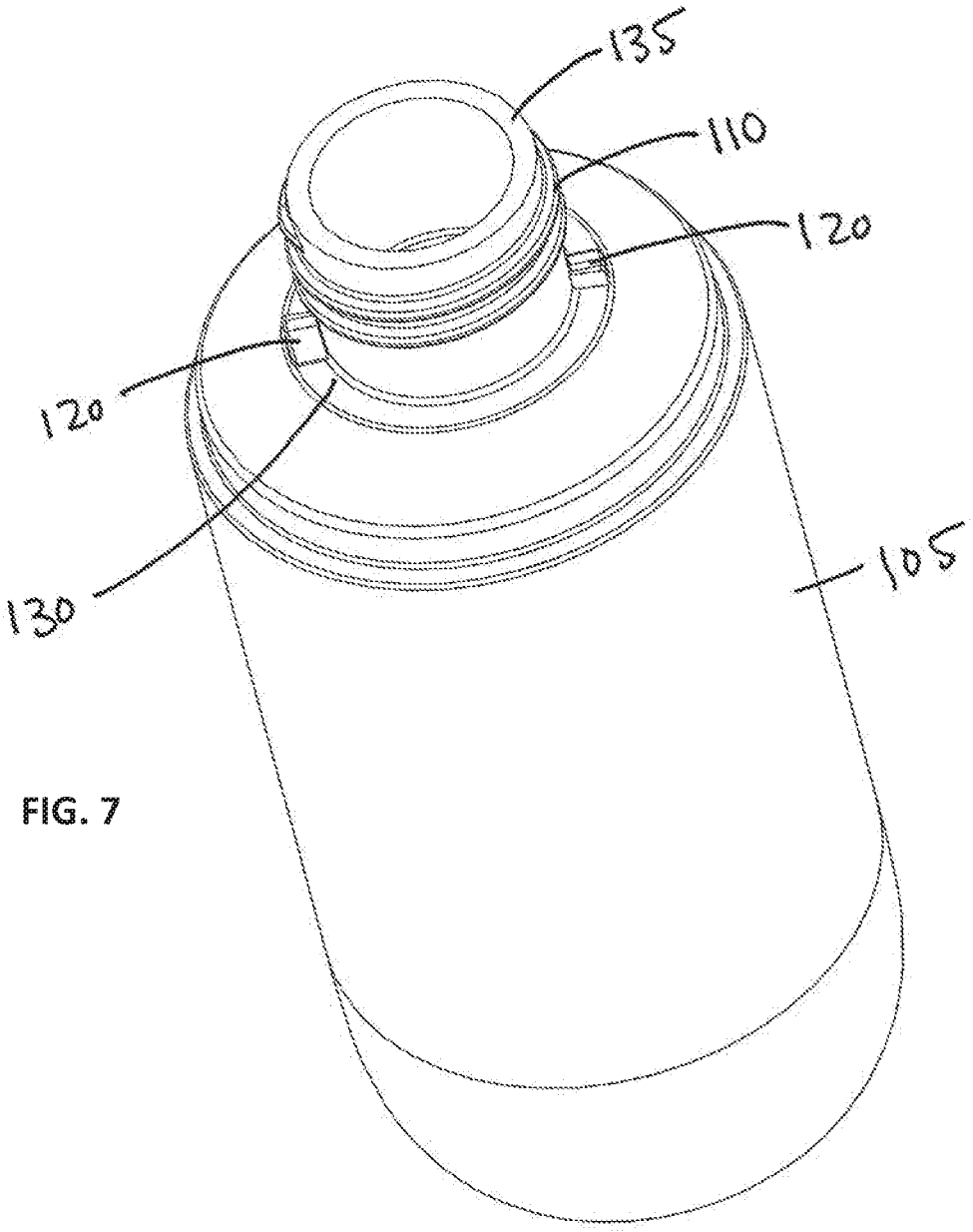
FIG. 7 is a perspective view of a bottle for use with a child resistant, senior friendly container assembly in accordance with an embodiment of the invention.
Figure 8:
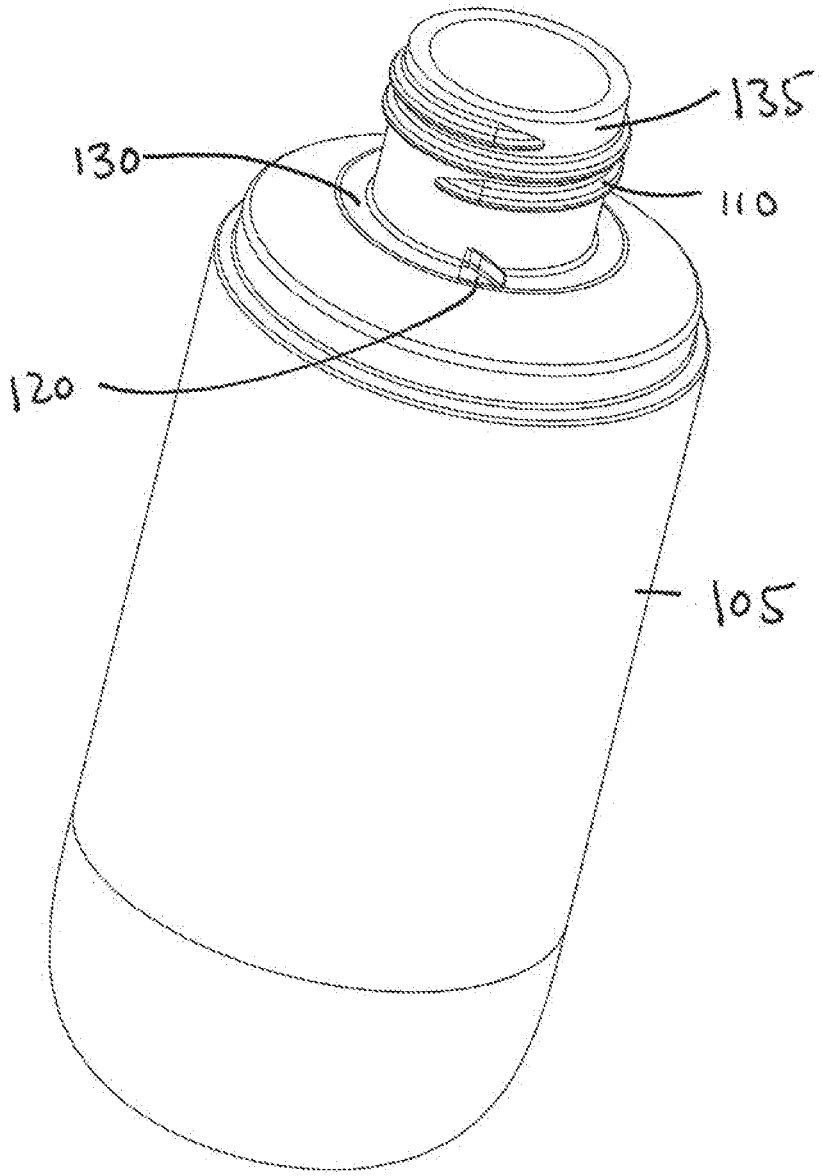
FIG. 8 is another perspective view of the bottle.
Figure 9:
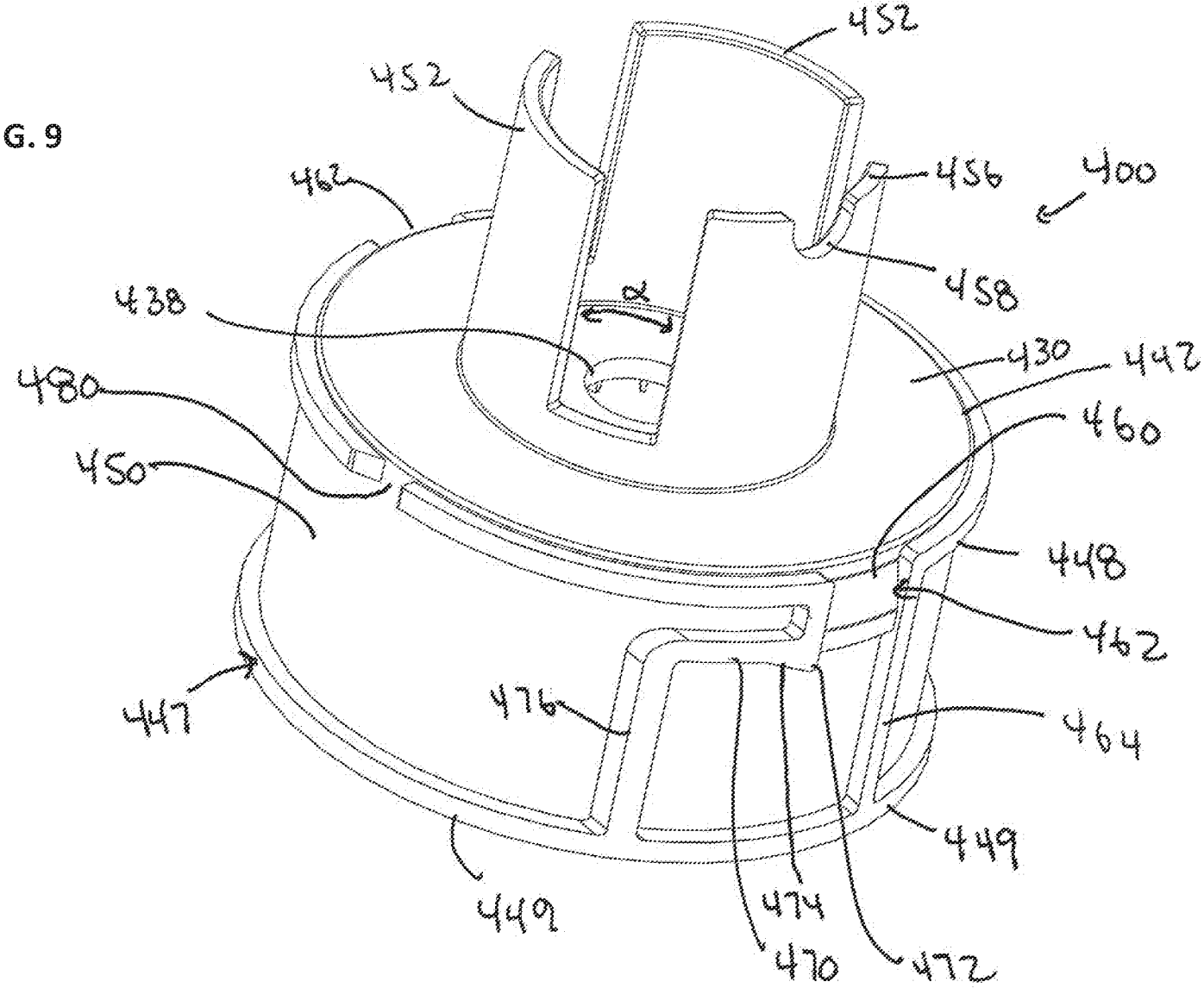
FIG. 9 is a perspective view of a housing sleeve for use with a child resistant, senior friendly container assembly in accordance with an embodiment of the invention.
Figure 10:
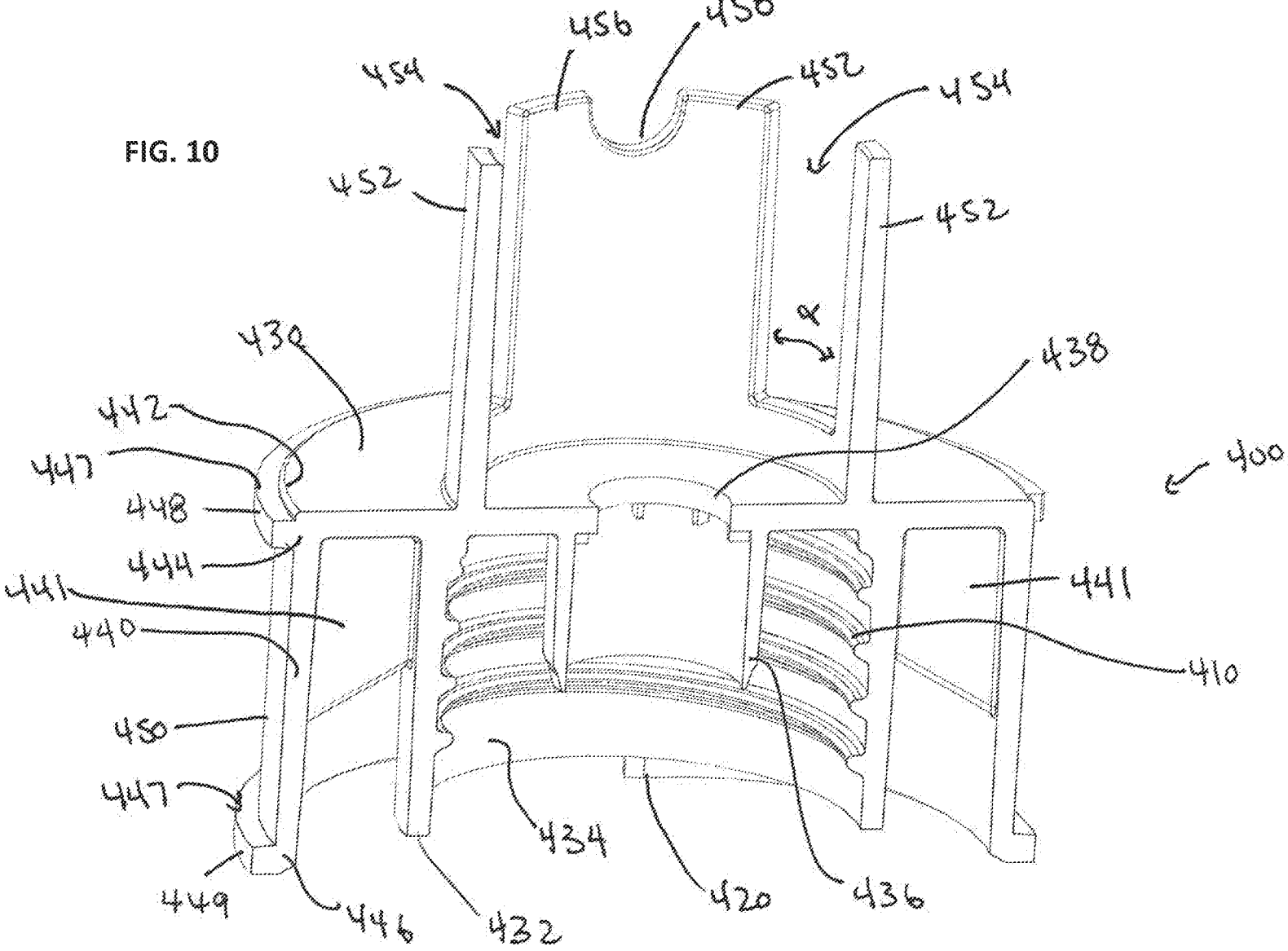
FIG. 10 is a sectional view of the housing sleeve.
Figure 11:
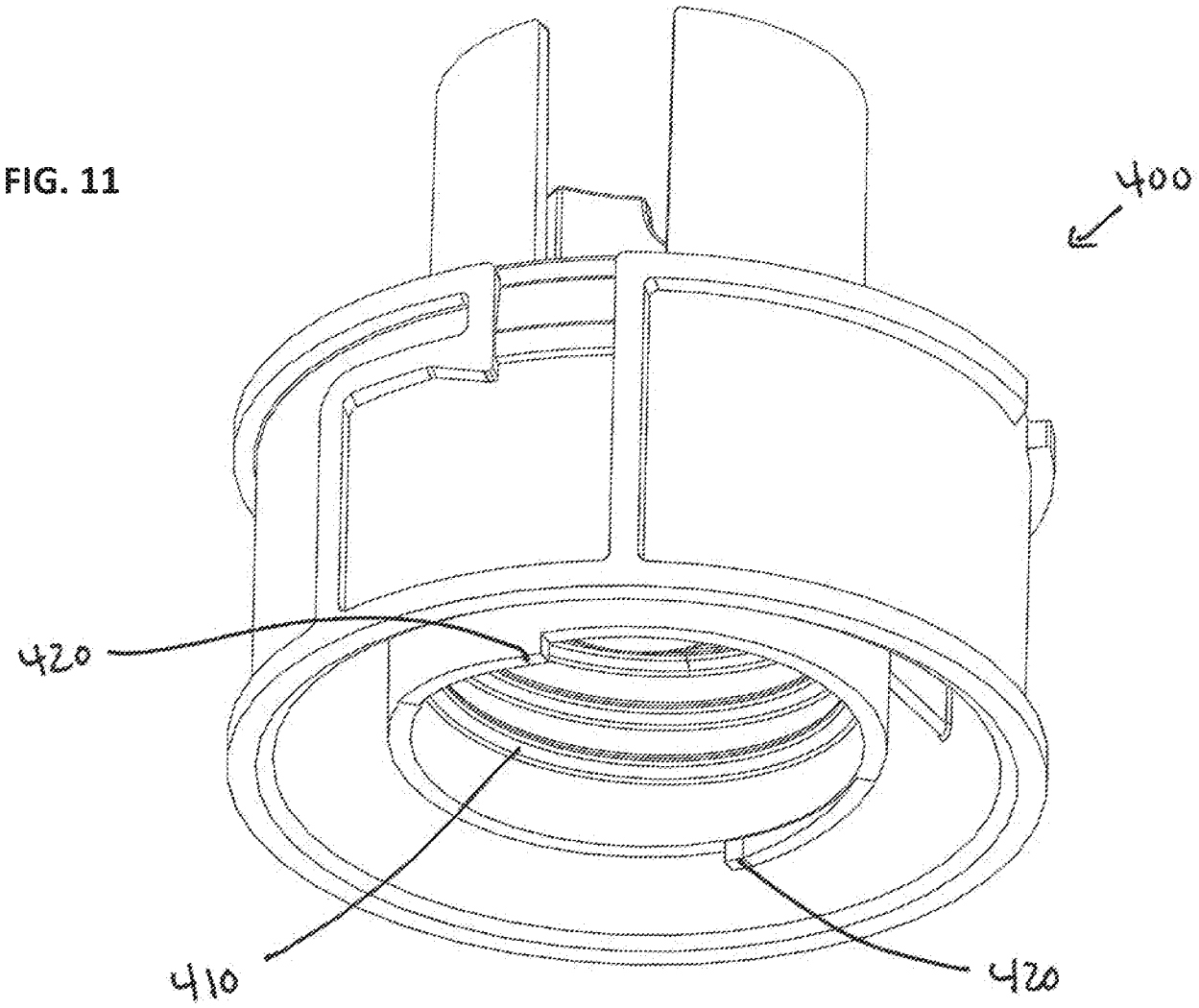
FIG. 11 is a perspective view of the housing sleeve from underneath the component.
Figure 12:
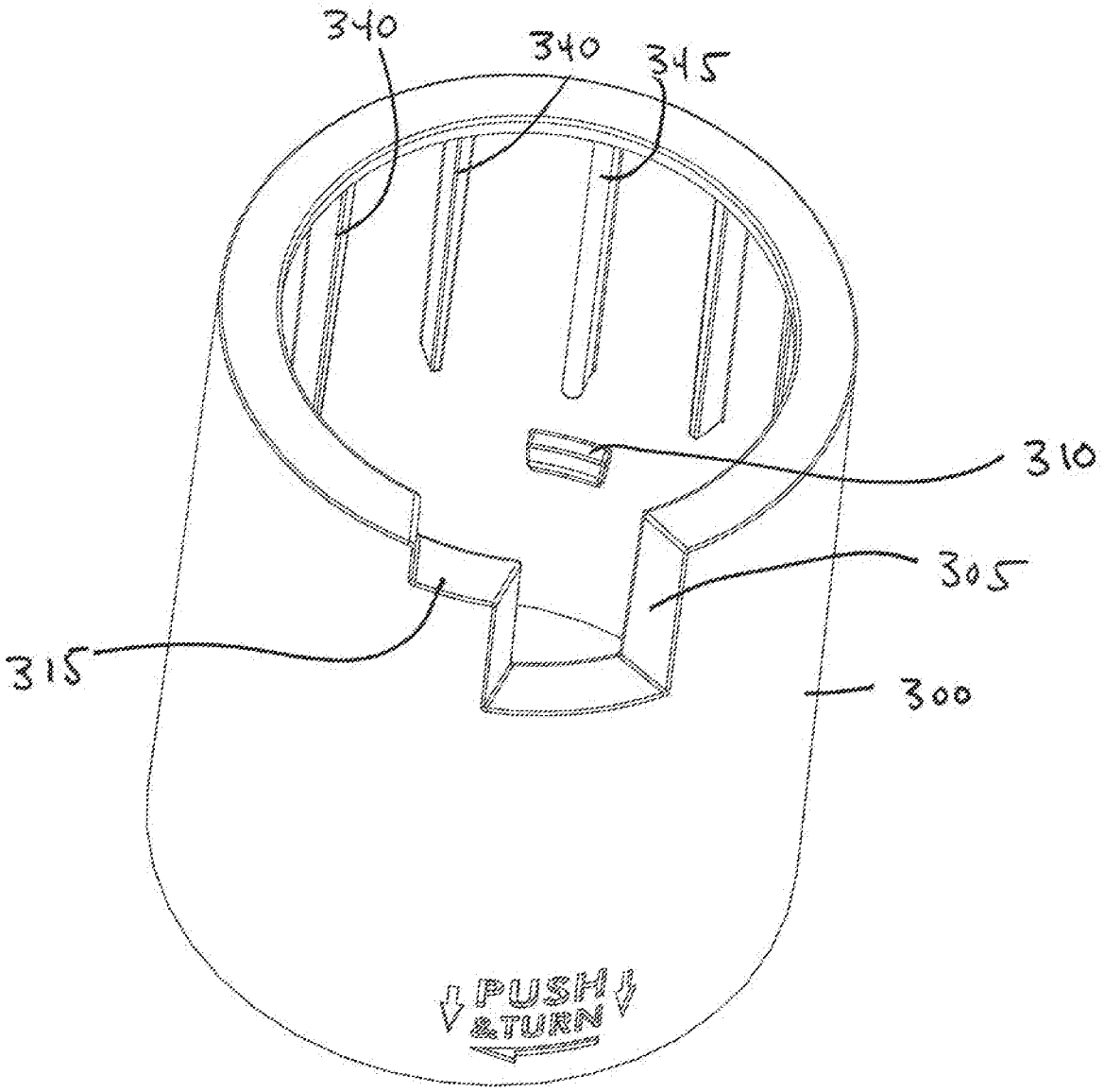
FIG. 12 is a perspective view of a collar for use with a child resistant, senior friendly container assembly in accordance with an embodiment of the invention.
Figure 13:
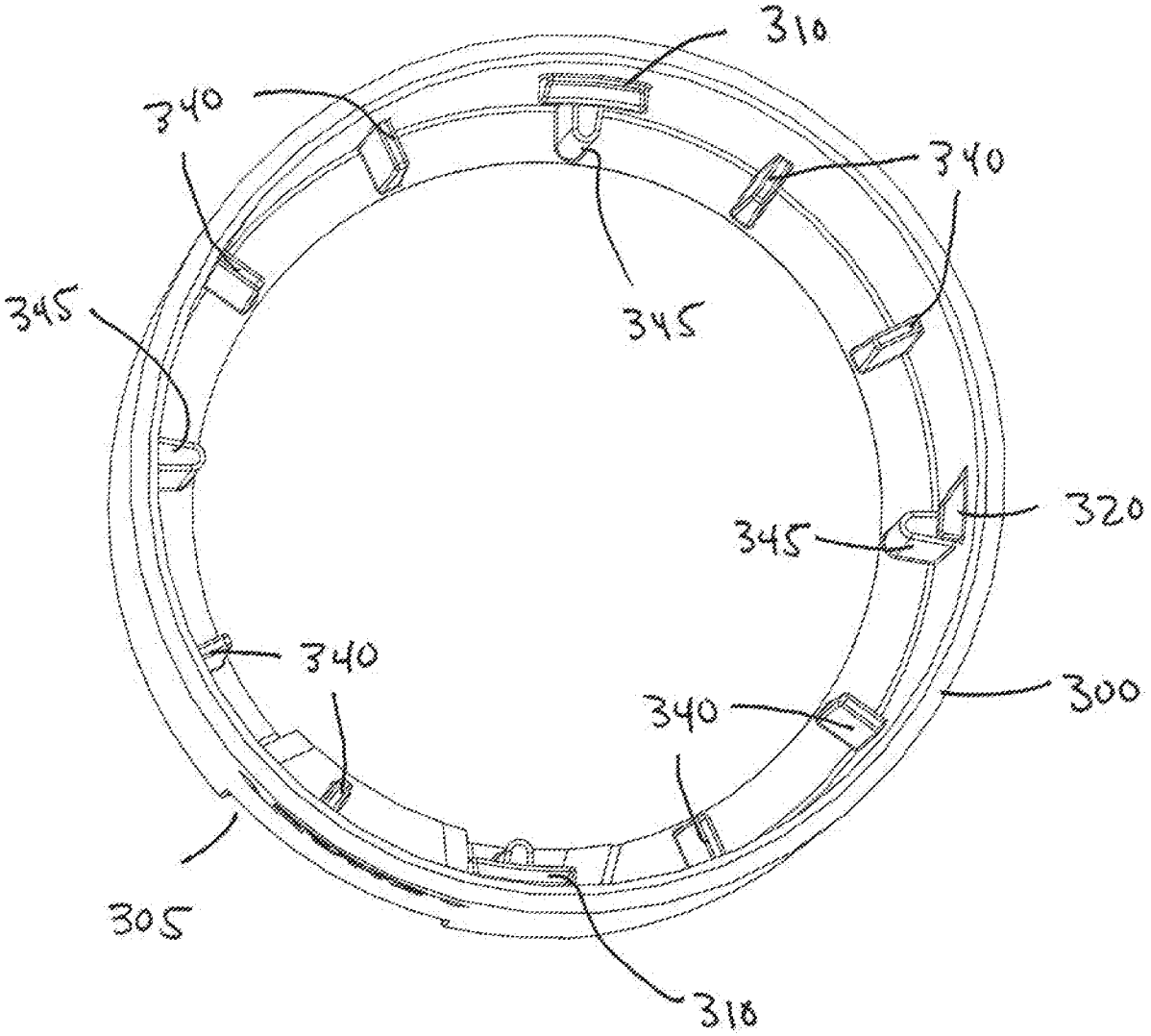
FIG. 13 is a bottom view of the collar.
Figure 14:
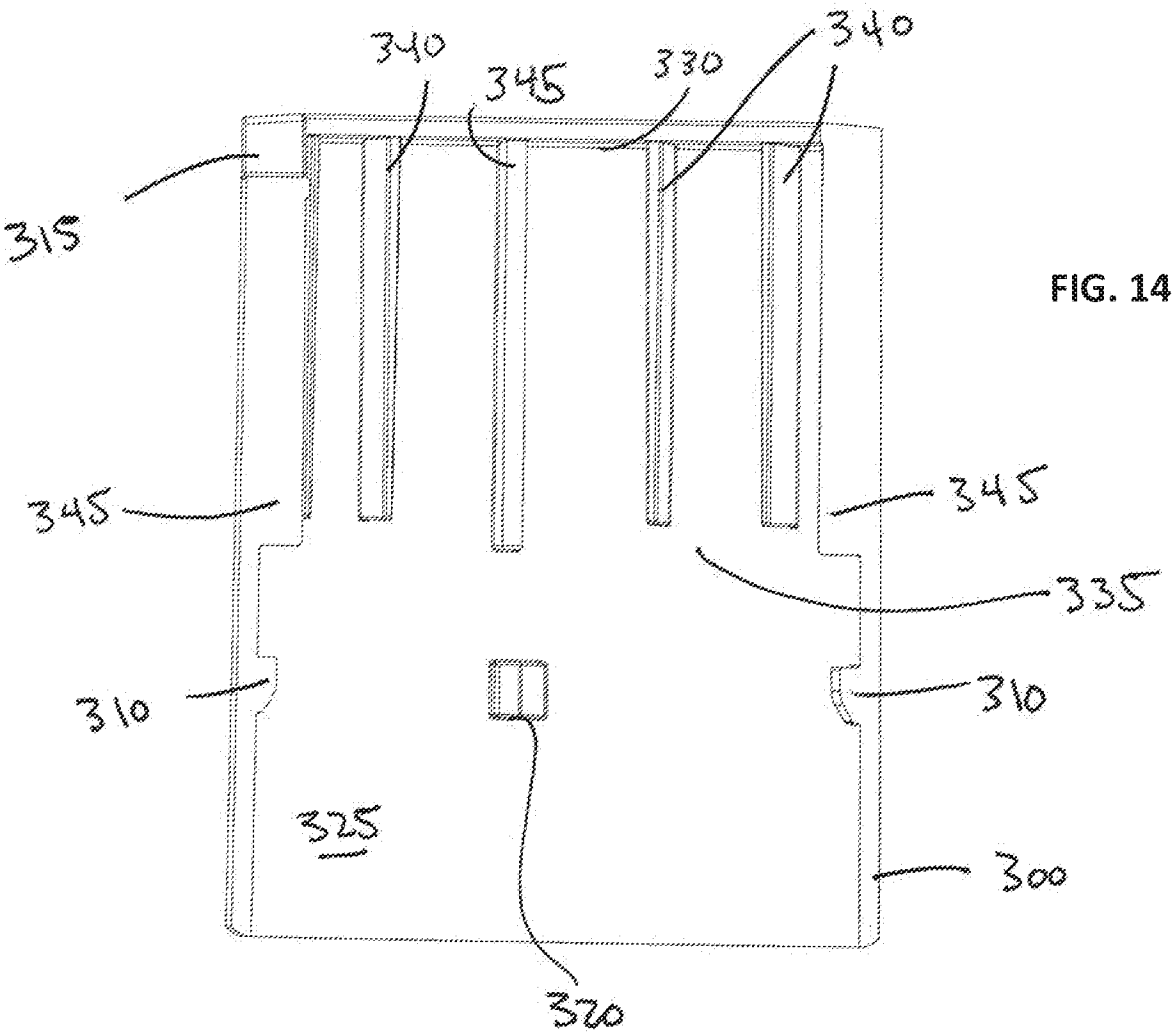
FIG. 14 is a sectional view of the collar.
Figure 15:
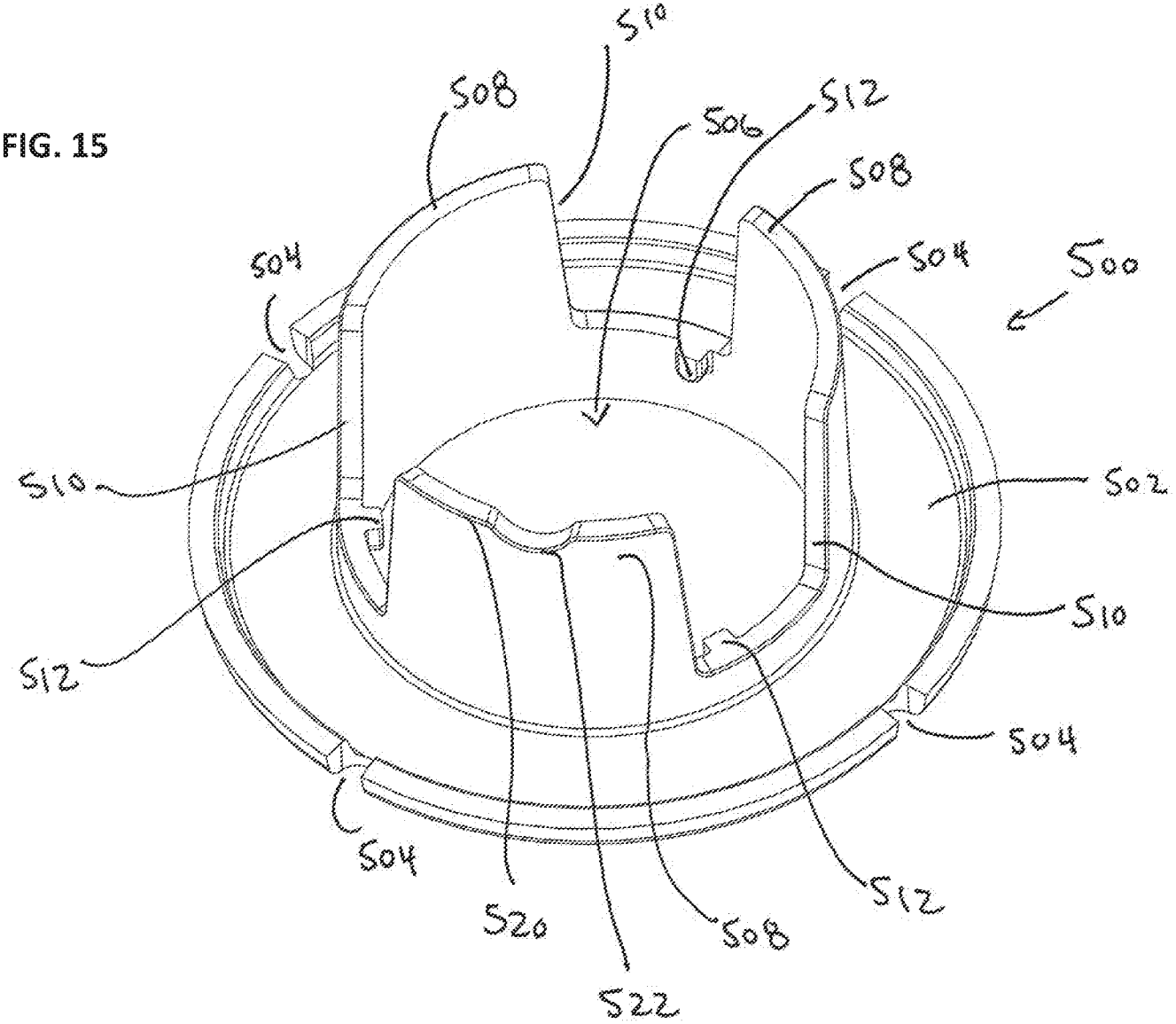
FIG. 15 is a shoulder spring sleeve for use with a child resistant, senior friendly container assembly in accordance with an embodiment of the invention.
Figure 16:
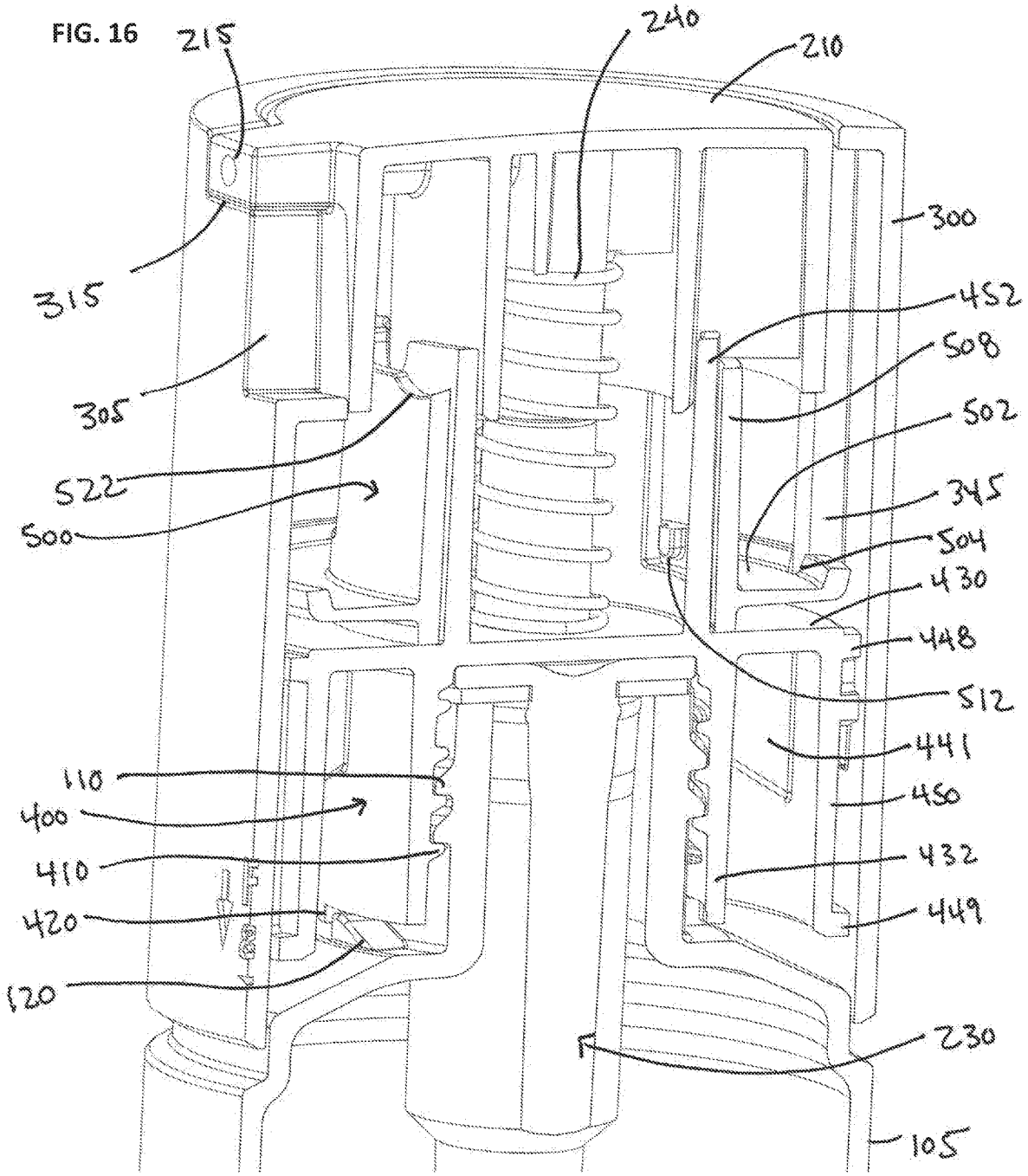
FIG. 16 is a sectional view of the container assembly illustrated in the locked position.
Figure 17:
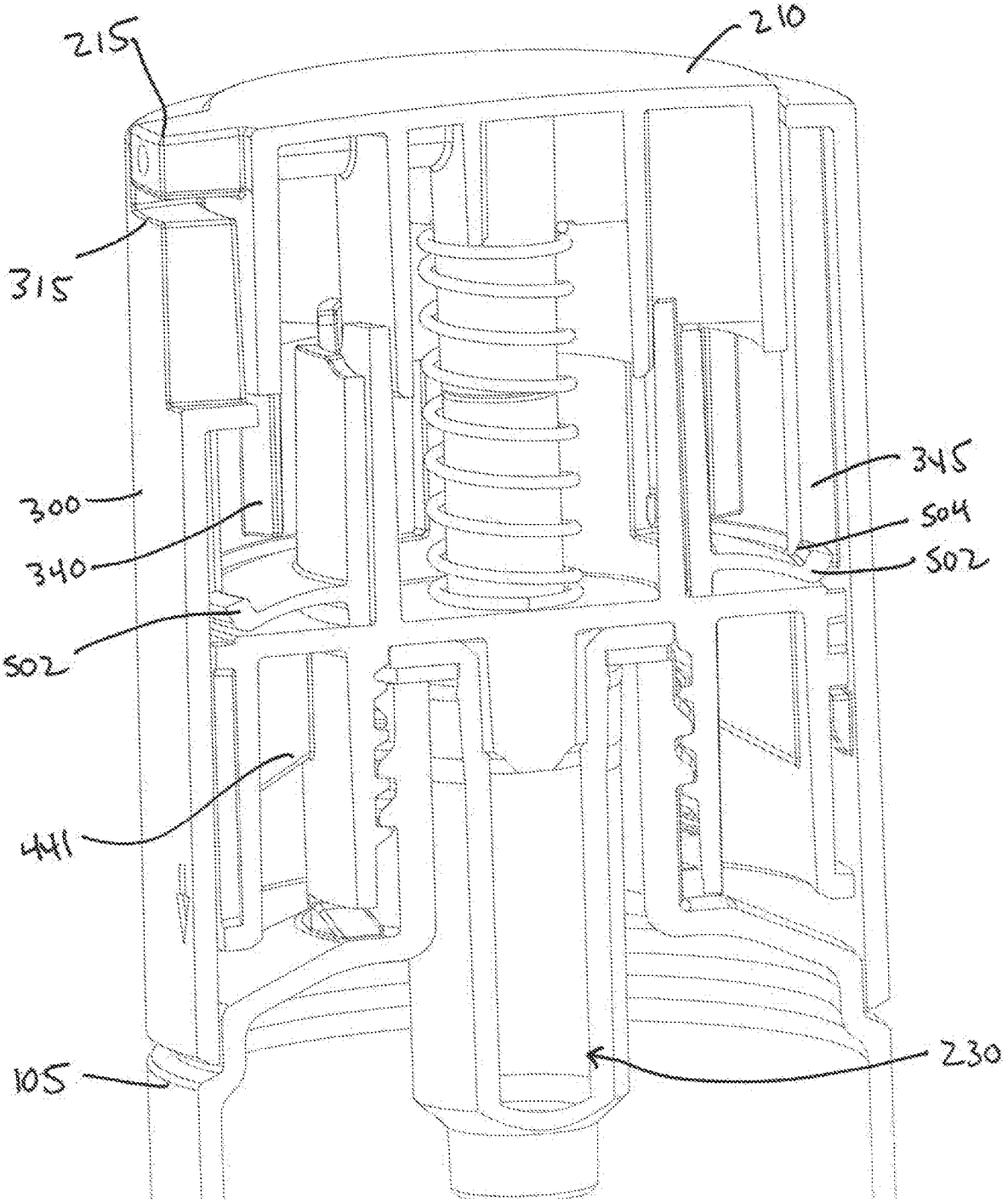
FIG. 17 is a sectional view of the container assembly illustrated with the collar in a pressed down position.
Figure 18:
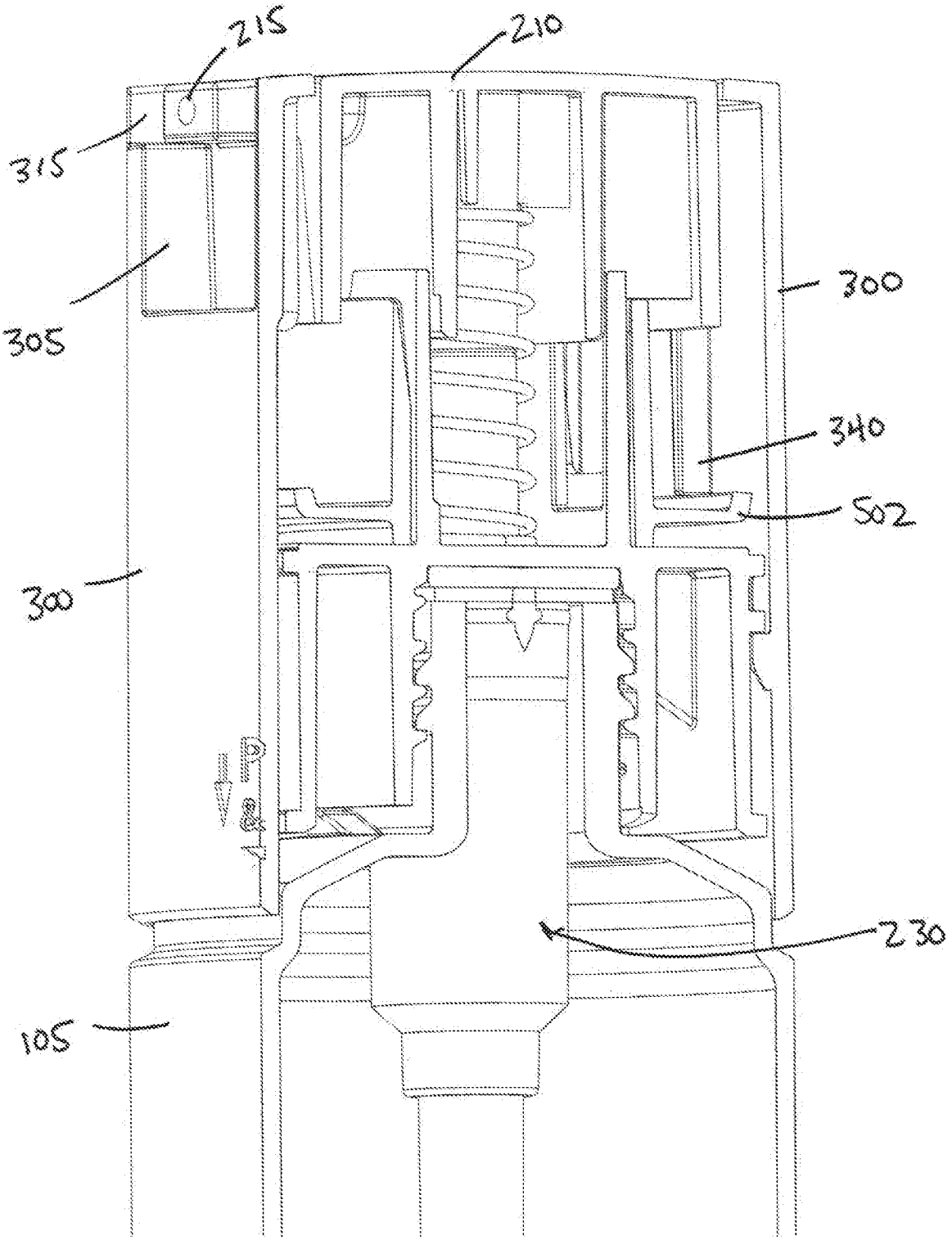
FIG. 18 is a sectional view of the container assembly illustrated in the unlocked position.
Figure 19:
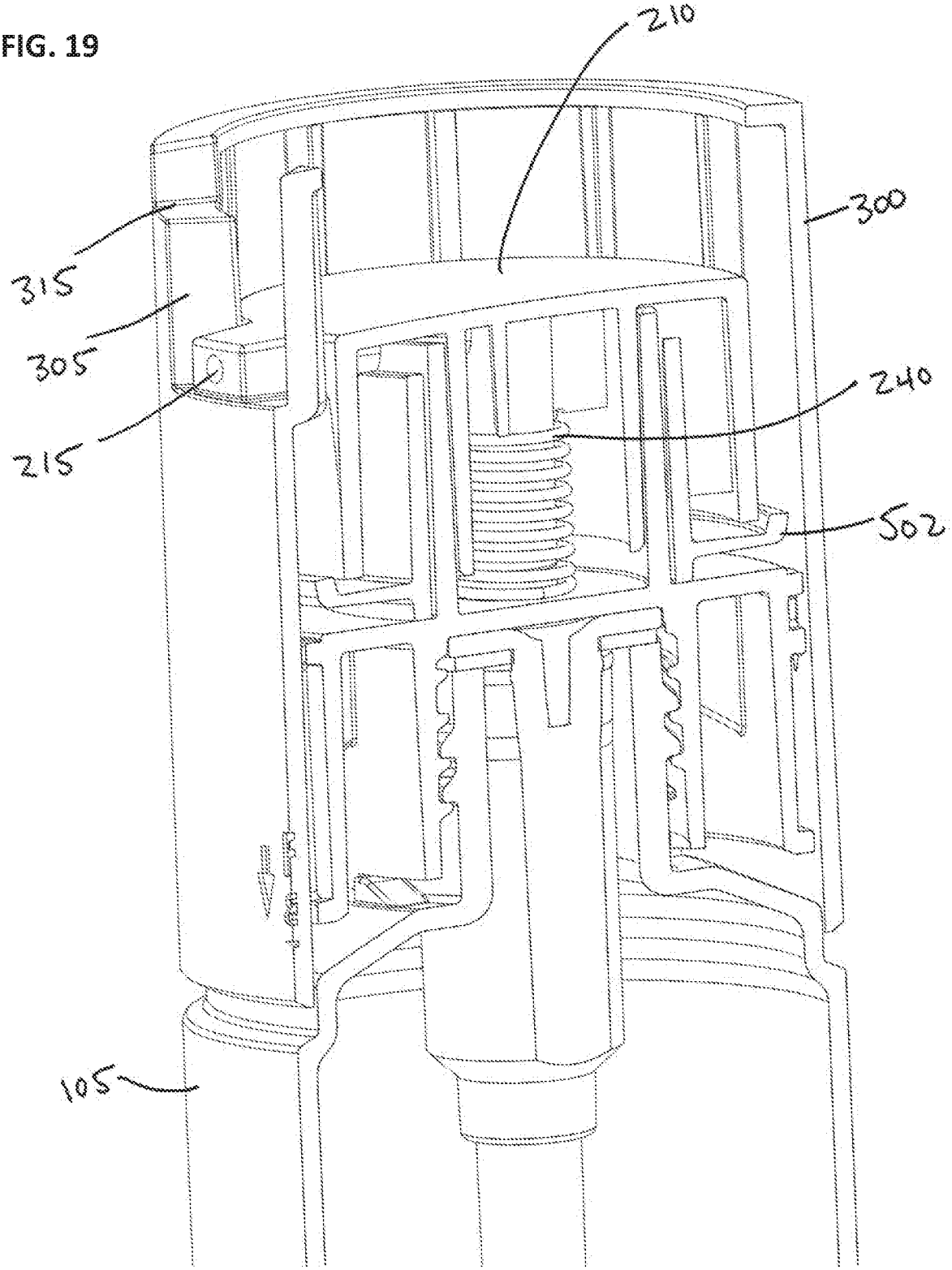
FIG. 19 is a sectional view of the container assembly illustrated with its actuator in a pressed down position.
Figure 20:
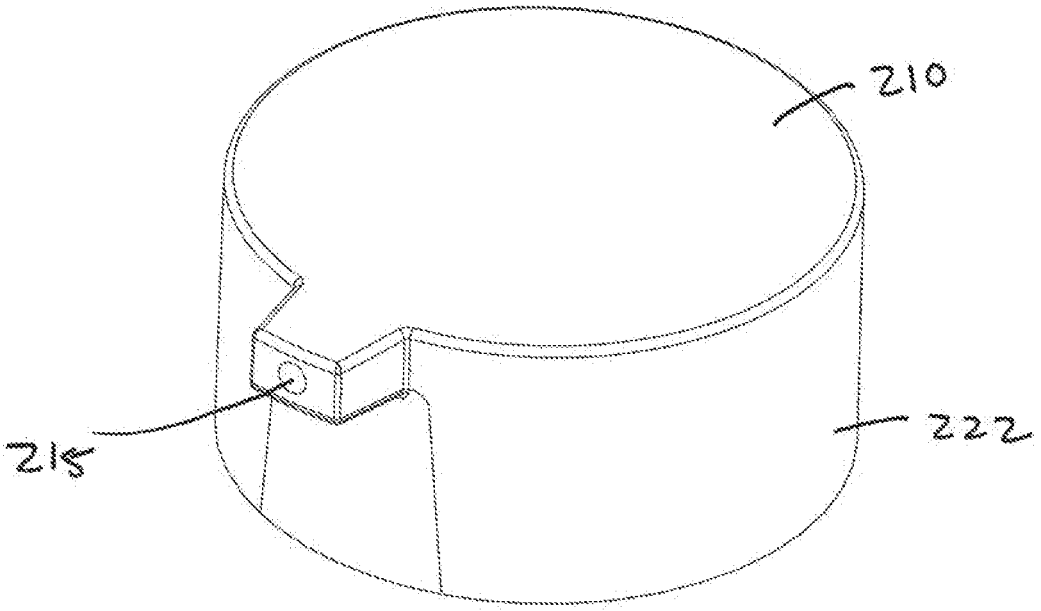
FIG. 20 is a perspective view of the actuator for use with a child resistant, senior friendly container assembly in accordance with an embodiment of the invention.
Figure 21:
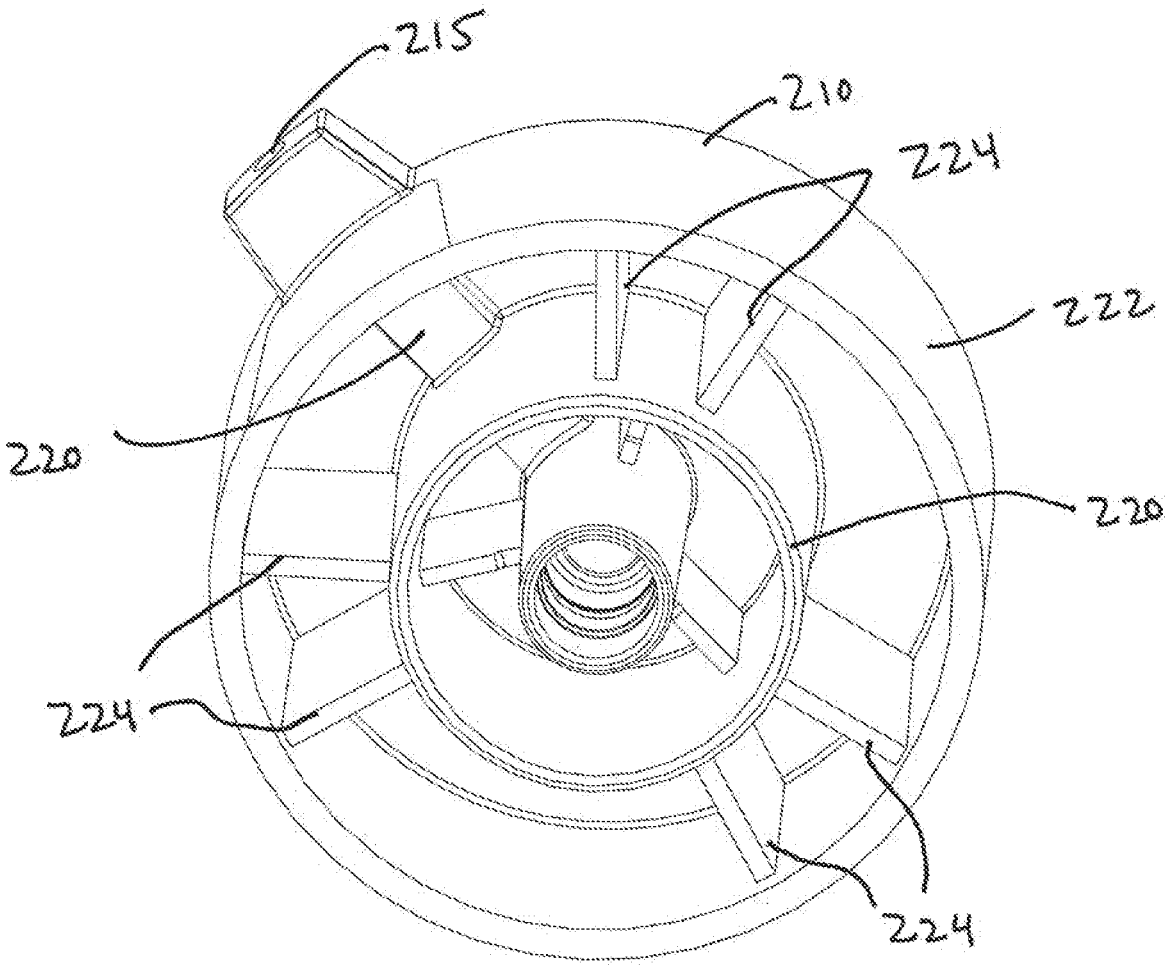
FIG. 21 is a view from underneath the actuator.
Figure 22:
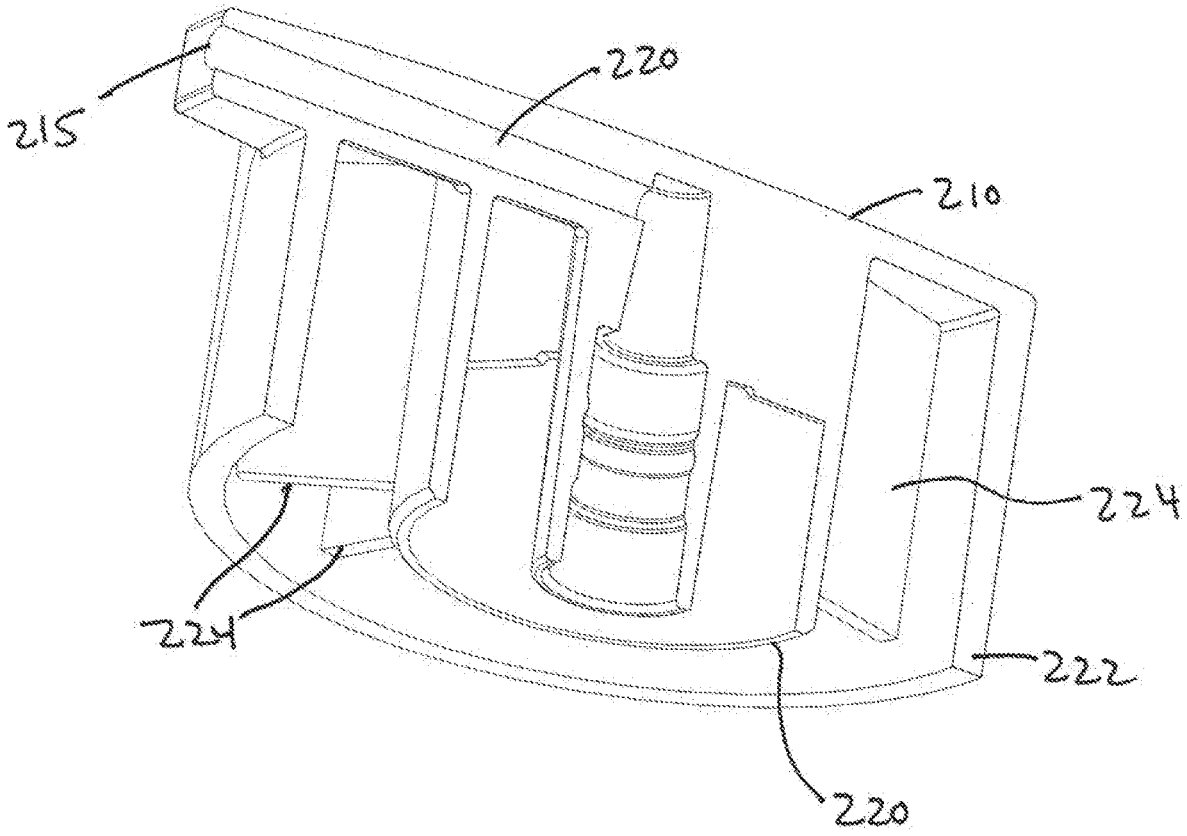
FIG. 22 is a sectional view of the actuator.
Figure 23:
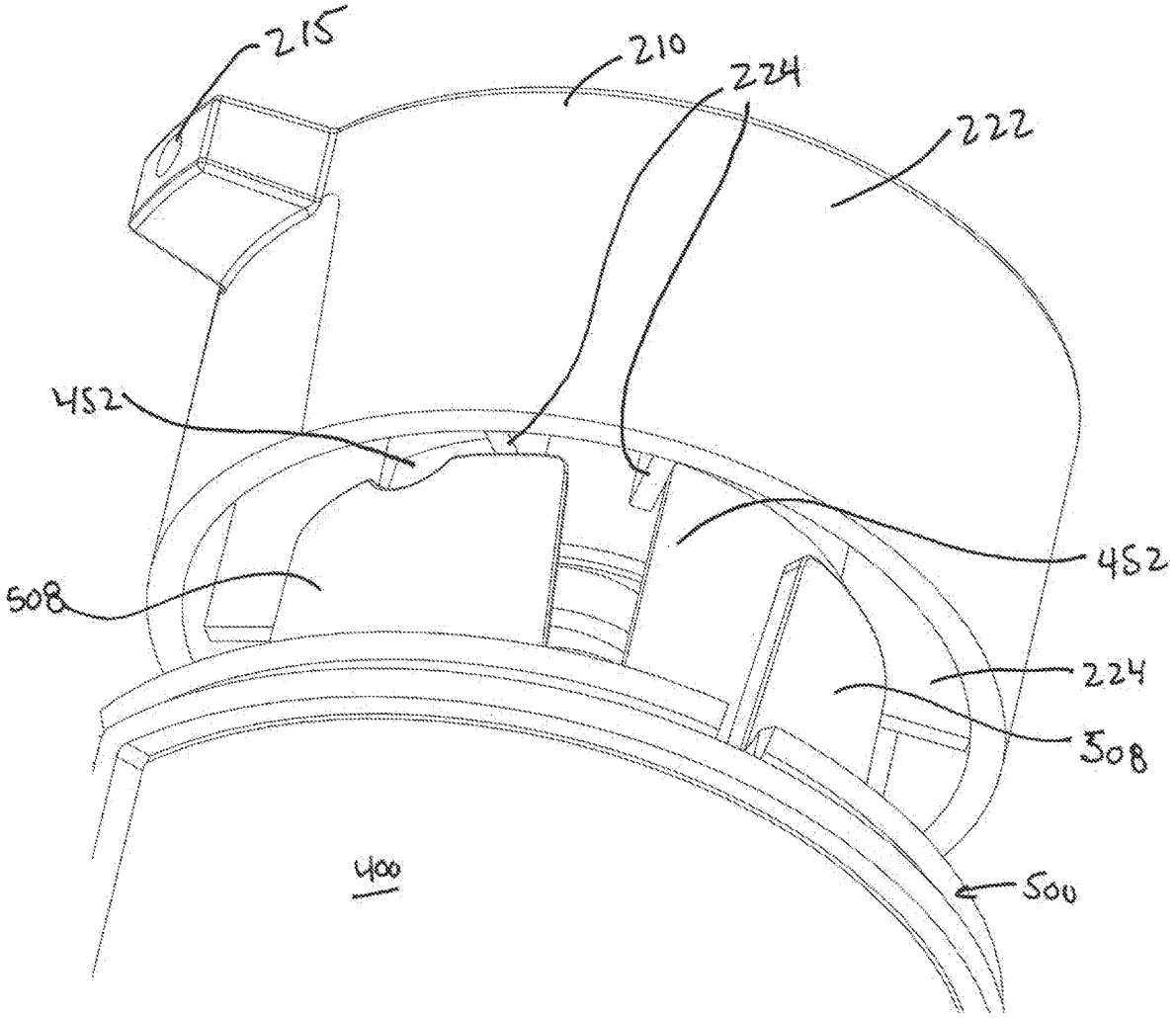
FIG. 23 is a partial component view of the container assembly with detail of the actuator being unable to be depressed.
Figure 24:
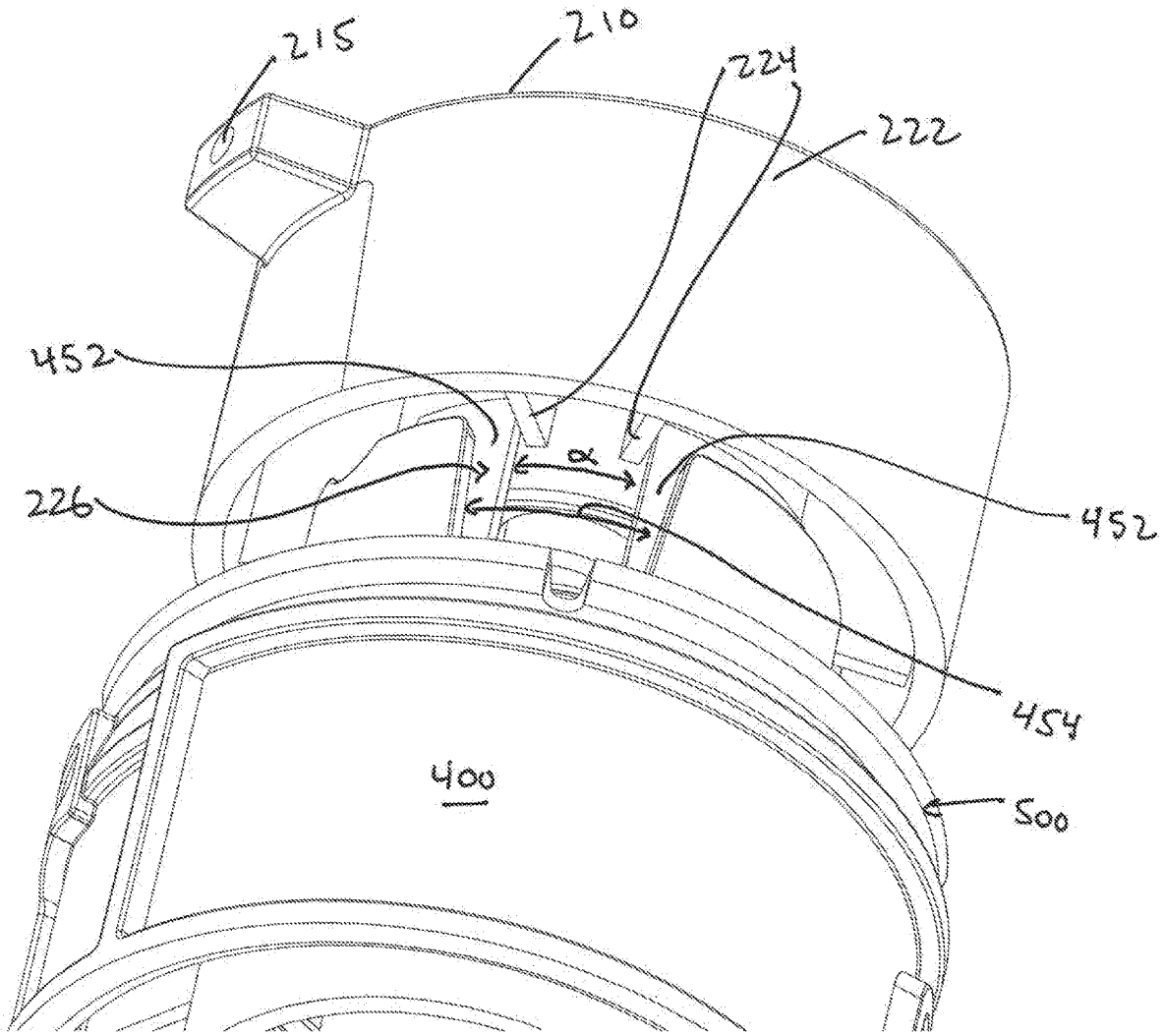
FIG. 24 is a partial component view of the container assembly with detail of the actuator being able to be pressed down.

Referring now to the figures, namely FIGS. 1 through 24, there is shown a container assembly 100 for the storing and dispensing of a liquid which may include forms of medication. The container assembly 100 is preferably a child-resistant container assembly 100. The container assembly 100 preferably includes a bottle 105 in communication with a dispensing mechanism 200 and a collar 300. The dispensing mechanism 200 is a typical dispensing mechanism that draws a liquid from the bottle 105 and ejects the same out of an outlet 215 when the actuator 210 or head piece is pressed down.

The container assembly 100 preferably employs a child-resistant adult-friendly means of locking/unlocking the dispensing mechanism 200. As illustrated in FIGS. 1 through 4, the user must press the collar 300 downwardly towards the bottle 105 and then turn the collar 300 slightly to unlock the dispensing mechanism 200. Although, to lock the dispensing mechanism 200, the user can simply turn the collar 300 back in the reverse direction. When locked, the outlet 215 of the head piece 210 is aligned with a ledge 315 in the collar 300 and when unlocked, the outlet 215 of the head piece 210 moves from the ledge 315 to become aligned with the slot 305 in the collar 300, which allows the head piece 210 to be pressed downwardly along the slot length 305 and which dispenses the contents of the bottle 105. While these types of press down and turn child-resistant mechanism exist in the marketplace, it is believed that the present invention in unique in its functionality.

The container assembly 100 has, as noted, a bottle 105, a dispensing mechanism 200, and a collar 300. The dispensing mechanism 200 includes (a) a dip tube 220 that is placed inside of the bottle 100, (b) the pump mechanism 230 which, as typically designed, is configured to manually pump liquid out of the interior of the bottle through the top tube 235, (c) the actuator or head piece 210 that includes the outlet 215, and (d) a compression spring 240 positioned around the top tube 235 and tends to force the head piece 210 back in an un-pressed position. The outlet 215 is in fluid communication with the top tube 235 when assembled. The container assembly 100 further includes housing sleeve 400 and a shoulder spring sleeve 500 that work in concert with the collar 300 to effectuate the child-resistant adult friendly locking/unlocking mechanism.

The bottle 105 is simply used to contain the liquid inside the bottle 105. The bottle could have threads 110 cooperatively used with threads 410 on the housing sleeve 400 (detailed below). The bottle 105 also has lugs 120 positioned at the base 130 of the bottle neck 135. A pair of lugs 120 are positioned 180° from each other and are cooperatively used with ramps 420 on the housing sleeve 400 (detailed below) to lock the bottle 105 to the housing sleeve 400. Once the bottle 105 is threaded to the housing sleeve 400 and the ramps 420 are turned past the lugs 120, reverse turning or unthreading the bottle is prevented.

The housing sleeve 400 includes a housing base 430 that includes a centered annular well 432 extending downwardly from the base 430 and include the threads 410 internally positioned on an outer well surface wall 434 and which cooperate with the threads 110 on the bottle. The outer well surface wall 434 therefore wraps around and captures the outside neck 135 of the bottle 105. On the bottom surface of the outer well surface wall 434 are the pair of ramps 420 that extend below the well 432 and which cooperatively lock against the lugs 120 on the bottle 105. The well 432 is bored therethrough by opening 438 and includes an inside well surface wall 436 that fits within the inside of the neck of the bottle 105 and provides access and a secure attachment for the dispensing mechanism's 200 access to the interior of the bottle 105. The housing sleeve 400 further includes an outer skirt 440 extending downwardly from an edge or outer portion 442 of the base 430. Strengthening members 441 are positioned between the outer skirt 440 and the well 432 to prevent the outer skirt 440 from flexing or bending when an external pressure is applied. The top portion 444 and the bottom portion 446 of the outer skirt 440 include lips 447 (upper lip 448 and lower lip 449) to create an annular channel 450 between the lips 447 against the outer skirt 440.

Extending upwardly from the base 430 of the housing sleeve 400 are curved housing panels 452, curving around the bore 438. The panels 452 are spaced from each other creating curved housing gaps 454 therebetween. Preferably there are three panels 452 equally spaced to create an arcuate angel $\alpha$ defined by the curved housing gaps defined between 15° and 45°, and more preferably of about 35°. The angle $\alpha$ provides clocking mechanism for rotational movement of the shoulder spring sleeve 500 in relation to the housing sleeve 400 (described below). In addition, one of the curved panels 452 has a top portion 456 with a notch 458 configured to accommodate a conduit 220 on underside of the head piece 210 (detailed below).

The upper lip 448 includes a pair of oppositely disposed entrance ramps 460, each ramp creating an opening 462 in the upper lip 448. The ramps 460 prevent the removal of the collar 300 once secured over the housing sleeve 400 (described below). On one side of the entrance ramps 460 is a first rotational stop flange 464 extending downwardly between the upper lip 448 and lower lip 449 to prevent over rotation of the collar 300 towards the particular direction (described below). On the other side of each ramp 460 is a lock/unlock guidepost 470. The guidepost 470 includes a detent 472 adjacent to and positioned below the ramp 460. The detent 472 leads into a sloped projection 474 that further travels along the guidepost 470 to a second rotational stop flange 476 extending downwardly to the lower lip 449 to prevent over rotation of the collar 300 towards that particular direction (described below). As further noted, once the collar 300 is secured over the housing sleeve 400 the entrance ramps 460 prevent removal of the collar 300 and the guidepost 470 creates a locked positioned and unlock positioned for the dispensing mechanism 200 and the head piece 210. Lastly, the upper lip 448 includes an orientation slot 480 positioned between the two ramps 460.

The collar 300 includes a pair of internal extending projections 310 and a single orientation flange 320 positioned between the two internal extending projections 310. When assembled, the pair of internal extending projections 310 rest below the ramps 460 in the locked position. To ensure the collar 300 is not assembled 180° out of alignment, a prior assembly only occurs when the single orientation flange 320 is aligned with the orientation slot 480. The collar 300 can then be pressed down moving the internal extending projections 310 below the detents 472 and allowing the collar 300 to twist towards the second rotational stop flange 476. Once the collar 300 is twisted, the head piece 210 is aligned with the channel 305 in the collar 300, allowing the head piece 210 to be pressed down and dispense liquid from the bottle. Once down the collar 300 can simply be twisted back (without pressing down) moving the internal extending projections along the guidepost 470 and sloped projection 474 back below the entrance ramps 460 and such that the head piece 210 is positioned against the ledge 315 in the collar 300. The first rotational stop flange 464 acts to stop rotation of the collar 300 in that particular direction.

The collar 300 further includes a set of elongated ribs extending downwardly along an internal surface 325 from an upper section 330 of the collar to about a mid-section 335 of the collar. The ribs include a first set 340 and a second set 345, where the first set 340 are shorter than the second set 345 and the second set 340 are separated and interspaced among the first set 345. As detailed below, the first set of ribs 340 are configured to press against a shoulder portion 502 defined from the shoulder spring sleeve 500, while the second set of ribs 345 correspond to and slide into positioned slots 504 defined on the shoulder portion 502. When assembled, rotation of the collar 300 will cause rotation of the shoulder spring sleeve 500.

The shoulder spring sleeve 500 as noted includes a shoulder portion 502 extending from a circular opening 506 that is sized to receive the curved housing panels 452 on the housing sleeve 400. Extending upwardly around the circular opening 506 are shoulder panels 508 spaced from each other to create shoulder gaps 510 therebetween. In addition, adjacent each shoulder gap 510 are knobs 512 extending inwardly. The knobs 512 are configured to sit within the housing gaps 454 of the housing sleeve 400. Thus, when the shoulder spring sleeve 500 rotates with the rotation of the collar 300, the knobs 512 further restrict rotation travel in the shoulder gaps 510 between the housing panels 452.

In addition, the shoulder portion 502 is configured to resist flexing. During operation, the collar 300 must be pressed down first, causing the first set of ribs 340 that are pressed against the should portion 502 to flex a portion of the shoulder portion 502. When the downwardly force against the collar 300 is released, the shoulder portion 502 resisting the flex will tend to force the collar 300 back to a resting position.

In addition, one of the shoulder panels 508 has a top portion 520 with a notch 522 configured to align with the notch 458 on the curved housing panel 452 and further configured to accommodate a conduit 220 on underside of the head piece 210 (detailed below).

The actuator or head piece 210 includes the outlet 215 and a conduit 220 that is a fluid connection between the outlet 215 and the upper tube 235. The head piece 210 includes an interior skirt 220 extending downwardly within the exterior skirt wall 222. Pairs of ribbing members 224 connect the interior skirt to the exterior skirt. The head piece 210 when assembled is aligned such that each of the pairs of ribbing members 224 are positioned between two of the curved housing panels 452. In addition, the shoulder panels 508 that are positioned on the outside of the housing panels 452 are shorter than the housing panels 452, such that the pairs of ribbing members do not interfere with the rotation of the shoulder spring sleeve 500. As such, rotation of the shoulder spring sleeve 500 (with the rotation of the collar 300) does not rotate the head piece 210. However, when rotated and aligned to the unlocked position, the shoulder gap 510 aligns with the housing gaps 454 a channel 226 is created for the pairs f ribbings 224, when the head piece 210 is pressed downwardly. In addition, when in the unlocked position, the notch 522 on the shoulder panel 508 is aligned with the notch 458 on the curved housing panel 452 such that when the head piece 210 is pressed downwardly, the conduit 220 sits into the notches to ensure a full travel distance.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A child-resistant, adult-friendly, container assembly to dispense a liquid, the container assembly comprising:

a bottle having an internal reservoir for containing a liquid;

a dispensing mechanism having a head piece configured to be actuated directly by a user, the dispenser mechanism being in communication with the internal reservoir and having an outlet configured for dispensing liquid external to the container assembly when the head piece is actuated downwardly from a resting position;

a collar surrounding the dispensing mechanism and the collar configured for movement in relation to the dispensing mechanism, the collar having a locked orientation configured to prevent actuation of the dispensing mechanism and to prevent twisting of the collar in a first direction, an unlocked orientation to permit actuation of the dispensing mechanism and to permit twisting of the collar in a second direction, and an intermediate orientation configured to allow twisting of the collar in the first direction to the unlocked orientation, and the collar further having a ledge and an adjacent slot, wherein the outlet is positioned on the ledge when the collar is in the locked orientation and positioned in the slot when the collar is in the unlocked orientation;

a housing sleeve having a first portion secured to the bottle and having at least one locking lug to prevent separation of the bottle from the housing sleeve, and the housing sleeve further having a second portion secured to the dispensing mechanism to prevent separation and prevent rotational movement of the dispensing mechanism in relation to the bottle; and a shoulder spring sleeve fitted around the second portion of the housing sleeve and configured to rotate in relation to the housing sleeve, and the shoulder spring sleeve secured to the collar such that movement of the collar causes movement of the shoulder spring sleeve.

2. The container assembly of claim 1, wherein the dispensing mechanism further includes a compression spring configured to force the head piece back to the resting position.

3. The container assembly of claim 1, wherein the first portion of the housing sleeve is further defined as having:

a housing base defined between the first portion and second portion;

the first portion being further defined to include:

a centered annular well extending downwardly from the base, the annular well having threads configured to cooperate with threads defined on a neck of the bottle;

the annular well being bored through the housing base to receive a portion of the dispensing mechanism into the internal reservoir of the bottle; and the first portion further defined to include an outer skirt extending downwardly from an edge of the housing base with strengthening members positioned between the outer skirt and the well configured to prevent flexing of the outer skirt; and the second portion being further defined to include:

housing panels extending upwardly from the housing base and curving around the bored annular well in the housing base, the housing panels being spaced from each other to define housing gaps therebetween.

4. The container assembly of claim 3, wherein the annular well of the housing sleeve having a bottom edge with at least one ramp extending therefrom, the at least one ramp configured to lock against the at least one locking lug when the annular well is fully threaded to the bottle neck thereby preventing counter-rotation of the bottle.

5. The container assembly of claim 4, wherein the collar and the housing sleeve are configured to work in concert to provide the unlocked, locked, and intermediate orientations, wherein the housing sleeve is further defined to include:

at least one channel on the outer skirt of the first portion of the housing sleeve, each channel having an entrance ramp, first and second rotational stop flanges positioned downwardly on the channel and positioned on either side of the entrance ramp, and a guidepost positioned on one side of the channel opposite to the first rotational stop flange and between the entrance ramp and the second rotational stop flange, the guidepost further having a detent adjacent to and positioned below the ramp and having a sloped projection between the detent and the second rotational stop flange; and wherein the collar is further defined to include:

at least one internally extending projection, each corresponding to at least one channel, wherein when the collar is assembled over the housing sleeve, the internally extending projection secures over the entrance ramp, preventing removal of the collar from the housing sleeve, and further configured to define: (a) the locked orientation that prevents twisting movement of the collar, when the projection is secured below the entrance ramp and positioned between the first rotational stop flange and the detent, (b) the intermediate orientation that allows twisting movement of the collar, when the collar is pushed down such that the projection is below the detent, and (c) the unlocked orientation, when the collar is positioned between the detent and the second rotational stop flange.

6. The container assembly of claim 5, wherein the collar and the shoulder spring sleeve are configured to work in concert to maintain the collar in an upward position, and wherein the shoulder spring sleeve includes:

a shoulder portion extending from a circular opening, wherein the circular opening is sized to receive the housing panels on the housing sleeve, the should portion having slots defined on the periphery thereof, shoulder panels extending upwardly around the circular opening and positioned such that the housing panels are adjacent to the inside of the shoulder panels, the shoulder panels being spaced from each other to create shoulder gaps therebetween, each shoulder gap having a knob extending inwardly and being configured to extend in the housing gaps between the housing panels, the shoulder portion being further made of a material configured to resist bending; and wherein the collar further includes:

a plurality of elongated ribs extending downwardly along an internal surface of the collar, and wherein the plurality of elongated ribs is defined as a first set of short ribs interspaced between a second set of long ribs, each of the long ribs being equally spaced from each other and defined to having a lower end fitted into one of the slots on shoulder spring sleeve, thereby securing the collar to the shoulder spring sleeve, and each of the short ribs being defined to having a lower end positioned against an edge of the shoulder portion, wherein when assembled, rotation of the collar causes rotation of the shoulder spring sleeve, and a downward force externally exerted onto the collar causes the short ribs to flex the shoulder portion which will return the collar to an upward resting position when the downward force is released.

7. The container assembly of claim 6, wherein the head piece includes:

the outlet and a conduit in fluid connection between the outlet and the internal reservoir of the bottle, an exterior annular skirt extending downwardly and an interior annular skirt extending downwardly within the exterior annular skirt, and pairs of ribbing members connecting the exterior skirt to the interior skirt.

8. The container assembly of claim 7, wherein the collar, head piece, housing sleeve and the shoulder spring sleeve are configured to work in concert when assembled to define:

the pairs of ribbing members being configured to extend from the head piece into the housing gaps between the housing panels to prevent rotation of the head piece when the collar is rotated, an unaligned position between the housing gaps and shoulder gaps when the collar is in the locked orientation configured such that the shoulder panels are positioned below the pairs of ribbing members to prevent the head piece from being pressed downwardly, and an aligned position between the housing gaps and shoulder gaps when the collar and shoulder spring are rotated to the unlocked orientation defining a channel between the housing panels and shoulder panels for horizontal movement of the head piece.

9. The container assembly of claim 7, wherein one of the shoulder panels has a top portion with a notch and wherein one of the housing panels has a top portion with a notch, and when the collar rotates to the unlocked orientation the shoulder panel notch and the housing panel notch align to accommodate the conduit on the underside of the head piece when the head piece is pressed downwardly.

10. The container assembly of claim 3, herein the housing panels are defined as three housing panels equally spaced from each other to define housing gaps with an arcuate angle of between XYZ.

11. The container assembly of claim 4, wherein the collar includes a pair of internal extending projections corresponding to a pair of entrance ramps, and the collar further having a single orientation flange configured to align to an orientation slot defined on a top portion of the outer skirt, wherein the orientation flange and orientation slot ensures the collar is properly aligned with the housing sleeve.

* * * * *